US006550771B1

(12) United States Patent
Weaver et al.

(10) Patent No.: US 6,550,771 B1
(45) Date of Patent: Apr. 22, 2003

(54) METHOD OF PLAYING AN OBJECT SELECTION GAME

(76) Inventors: John D. Weaver, 2195 E. Camero Ave., Las Vegas, NV (US) 89123; Janice L. Weaver, 2195 E. Camero Ave., Las Vegas, NV (US) 89123; Gary A. Ramos, 3251 Ridgewood Rd., Willits, CA (US) 95490

( * ) Notice: Subject to any disclaimer, the term of this patent is extended or adjusted under 35 U.S.C. 154(b) by 0 days.

(21) Appl. No.: 09/840,676

(22) Filed: Apr. 23, 2001

Related U.S. Application Data

(60) Provisional application No. 60/240,713, filed on Oct. 12, 2000.

(51) Int. Cl.[7] ..... A63F 1/00
(52) U.S. Cl. ..... 273/292; 273/274
(58) Field of Search ..... 273/274, 292, 273/309; 463/11–13

(56) References Cited

U.S. PATENT DOCUMENTS 2,782,039 A * 2/1957 Martin ..... 273/292
5,431,407 A * 7/1995 Hofberg et al. ..... 273/292
5,591,081 A * 1/1997 Suzuki ..... 463/13
5,839,730 A * 11/1998 Pike ..... 273/292

* cited by examiner

*Primary Examiner*—Benjamin H. Layno
*Assistant Examiner*—V K Mendiratta
(74) *Attorney, Agent, or Firm*—Ted Masters

(57) ABSTRACT

A method of playing an object selection game (20), includes providing a set of objects containing a plurality of different individual objects, wherein each individual object has an order value in accordance with an ordering rule. A subset of the set of objects is dealt to a player in accordance with a dealing rule. A portion of the subset of objects is revealed to the player in accordance with a revealing rule. The player then selects any previously unselected object from the subset of objects in accordance with a selecting rule. After each selection, a terminating rule is used to test whether play shall stop, or whether additional objects are selected. The terminating rule stops play if objects are not selected in proper sequential order in accordance with the ordering rule. After play is stopped, a score is computed in accordance with a scoring rule. In preferred embodiments, the set of objects are playing cards, and a wager is placed on the outcome of the game.

52 Claims, 14 Drawing Sheets

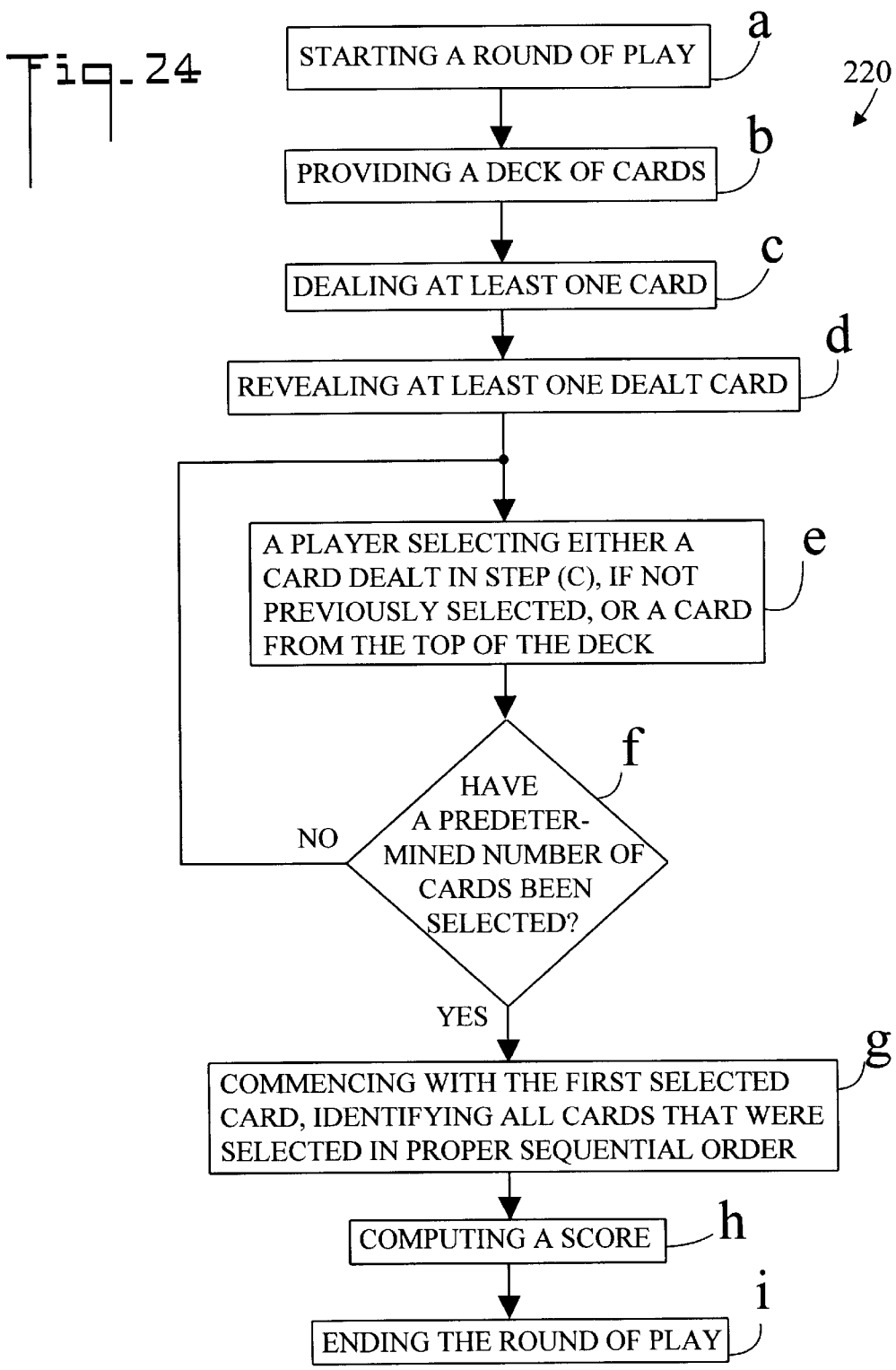
Fig. 24
220
STARTING A ROUND OF PLAY
a
PROVIDING A DECK OF CARDS
b
DEALING AT LEAST ONE CARD
c
REVEALING AT LEAST ONE DEALT CARD
d
A PLAYER SELECTING EITHER A CARD DEALT IN STEP (C), IF NOT PREVIOUSLY SELECTED, OR A CARD FROM THE TOP OF THE DECK
e
HAVE A PREDETER-MINED NUMBER OF CARDS BEEN SELECTED?
f
NO
YES
COMMENCING WITH THE FIRST SELECTED CARD, IDENTIFYING ALL CARDS THAT WERE SELECTED IN PROPER SEQUENTIAL ORDER
g
COMPUTING A SCORE
h
ENDING THE ROUND OF PLAY
i

METHOD OF PLAYING AN OBJECT SELECTION GAME

CROSS REFERENCE TO RELATED APPLICATION

This application claims the filing benefit under 35 U.S.C. §119(e) of U.S. Provisional Application No. 60/240,713, filed Oct. 12, 2000, which is included herein by reference.

TECHNICAL FIELD

The present invention pertains generally to games, and in particular to a game in which a player endeavors to select objects in a pre-established sequential order.

BACKGROUND ART

A number of games have been devised for casino play and wagering including, but not limited to, table games such as craps, roulette, and blackjack, and gaming devices such as slot machines and video display devices for games such as poker, keno, blackjack, and other familiar games of chance. In one sense these games can be divided into two broad categories, those which depend solely on random probabilities and require no player skill other than pulling a handle or pushing a button, and those which depend on a combination of random probabilities and player skill. By far the two most popular formats for gaming devices are the slot machine and the video poker machine. However, these two types of games often appeal to different groups of individuals. Those who play and enjoy slot machines may not enjoy playing video poker machines, and vice versa. Slot machines require no special knowledge or skill on the part of the player, whereas to play video poker machines well the player must have some understanding of the rules of poker. There then appears to be a middle ground which has not been addressed and which is embraced by the present invention. To wit, a game which does not require that a player understand the rules of a particular game, but rather only that the player be able to exercise some skill in placing objects in a predetermined sequential order.

DISCLOSURE OF INVENTION

The present invention is directed to a method of playing an object selection game. The game comprises a player attempting to place a plurality of objects in a predetermined sequential order. The player is rewarded according to how many correctly ordered objects have been achieved. In a preferred embodiment of the present invention, the player must decide during the course of the game whether to next select an object which has already been revealed, or alternatively to next select a hidden object. In accordance with another possible embodiment of the present invention, more than one object is revealed to the player, thereby increasing the player's chance of correctly placing the objects in proper sequence.

The present invention includes elements, rules, and logic as specified herein. The method of the subject invention is unique in that it involves a high degree of player interaction, making the game more attractive to the player than a game based purely on a random outcome (e.g., a slot machine), while still retaining a mostly random determination of the outcome. The game also provides for combinations and methods of playing the game which have certain winning combinations of very low probability, which makes it possible to offer certain payoffs of extreme value. High value payoffs are very attractive to players and are important if the game is used with a local area or wide area network where multiple games at different locations participate in a common high-value jackpot. In the current state of the art only multi-reel slot machines have been able to provide winning combinations of suitably low probability to support networks with high-value jackpots. To maintain player interest it is also important to have outcomes of high and moderate probability so that the player is rewarded with frequent small and medium payoffs. Such combinations are easily constructed using this method. These combinations of features are not available in other traditional games of chance.

NOTE: Examples [shown in italics] are intended to assist in forming a visualization of the elements, rules, or logic described and to be illustrative or suggestive of possible implementations, but not to limit the concept only to those examples presented. In particular, while the examples given use tangible physical realizations such as a gaming table or board game, it is well known that analogous electronic representations such as a video game and associated computer and computer program can be constructed using an identical logical basis. All realizations of this game which are based on the elements, rules, and logic described herein are therefore embraced by the present invention.

In the play of the game, a set (Pool) of distinguishable objects are provided. The specific distinguishing characteristics of some of the objects are obscured or hidden. Some of the objects may be revealed to the player before starting play. From time to time after play begins additional objects may be put into play. Once play has begun, the player selects the objects one at a time. Beginning with the second or a subsequent selection, the current selection and one or more of the previous selections are tested to see if they have been selected in an acceptable order according to an ordering rule. If so, the player is allowed to select another object and the comparison process is repeated. After each selection a terminating rule is invoked to determine whether play terminates or continues. After play terminates, the game is then scored according to the presence or absence of certain selected objects or combinations of objects.

If no objects are revealed to the player before the selection process begins, the game is essentially a pure game of chance, although by consciously making selection decisions, the player may subjectively feel that he is controlling the outcome. When one or more objects are revealed to the player before the selection process begins, an element of player skill is added which strongly reinforces the subjective feeling of control. This occurs because the player has knowledge of the objects which have already been selected as well as knowledge of the revealed objects which have not yet been selected. This knowledge allows the player to decide the best strategy for selecting the revealed objects. To what extent the actual outcome of the game is still predominantly determined by chance can be controlled by the selection of the various rules. These features make the present invention ideally suited for use as a gambling device, however it may also be utilized without the placement of wagers.

In one preferred embodiment, there is a correct solution or winning combination for every hand played in that no hands can be dealt which do not have a winning sequence. Whether or not the player achieves the win depends solely on the order in which the objects are selected. The shuffle or randomization of the objects changes their placement on the playing field but does not change the probability of the player selecting a winning combination. When used as a gambling device, the shuffle is used to randomly vary the maximum possible payoff amount for a winning hand. That is, all hands can be correctly placed in order, but certain hands will have more inherent value than others. With games like Poker, a winning hand is predominantly determined by the shuffle and, to a lesser degree, by the player's choice of which cards to hold or discard. Similarly, in Blackjack the results are mostly determined by the shuffle; the player exhibiting control only in deciding when to quit receiving cards from the deck.

The most essential ideas of this invention are (1) the selection of hidden objects which can be placed in a defined order or sequence, (2) the scoring of the game based on rules which determine the value of the objects which have successfully been selected and placed in order, (3) the concept of previewing some of the objects so that the player can exercise skill by altering his selection strategy, (4) the high degree of player interaction, (5) the ability to construct card games and other types of interactive games with certain outcomes of extremely low probability while retaining combinations of high and moderate probability, and (6) in certain embodiments, a method which provides that every hand is a potential winner regardless of how the objects have been shuffled.

GAME ELEMENTS AND RULES

The specific elements and rules of the game are these:

1) PLAYER The Player is allowed to be familiar with all the elements of the game, including the types of objects and all the rules. The player is not allowed to know which specific objects have been put in play or their relative positions on the Field. In some variations of the game all the available objects will be put in play and the player will know that, but the player still will not be allowed to know the actual position of each object on the Field.

2) DEALER The Dealer randomizes the objects in the Pool and distributes (deals) them onto the Field. In an electronic implementation this function is provided by a psuedo-random number generator and associated logic elements . . .

3) POOL The Pool comprises a set of objects wherein each individual object has an order property which allows the objects to be distinguished from one another. Examples of such sets of objects are: (a) a set of standard playing cards, (b) a subset of integer numbers such as the set {1, 1, 2, 5, 5, 5, 8}, (c) a set consisting of one blue circle, one red circle, two green squares, and three red triangles.

4) FIELD The Field (or dealing area) is the first of two physical sections of play. The Field must be able to contain all of the objects which are dealt and their hiding means, but has no particular organization.

5) RACK The Rack (or playing area) is the second of two physical sections of play. The Rack must be able to contain all of the objects which are selected according to the rules, but not their hiding means, and in addition it must have specific sequential locations for these objects or use some other method to preserve the order of their selection. The physical areas of the Field and the Rack may overlap in some embodiments of the game.

6) HIDING MEANS A means must be provided which disguises or hides the distinguishing properties of the objects which have been dealt until they have been revealed to or selected by the player in accordance with the rules. Examples of such means are: (a) cards having a Face which displays the object and a Back which is identical for all such cards in the set, such objects are hidden by displaying only the Backs of the cards to the player, (b) opaque cups or envelopes which are placed over the objects so that they cannot be seen, all such cups or envelopes having an identical appearance.

7) CLUSTER The Cluster is the subset of objects distributed from the Pool during the deal. The number of objects in the Cluster is referred to as the Cluster Size and must be greater than one.

8) DEALING RULE The Dealing Rule determines the process for distributing a subset of objects from the Pool and placing each chosen object onto the Field. The distribution process must randomize the dealt objects so that the Player cannot know which objects have been placed in the various locations on the Field. An example of such a rule is: Shuffle a deck of cards four times and deal nine cards face down off the top of the deck.

9) REVEALING RULE After the objects have been dealt none, one, or more, but not all, of the objects put onto the Field may be revealed to the player before play begins, in accordance with a Revealing Rule. Examples of such a rule are: (a) after seven cards are dealt face down the player is allowed free choice to reveal any two cards before play begins, (b) after five cards are dealt face down, turn the third card face up, (c) after six objects are placed in opaque envelopes none of the objects may be revealed before play begins.

10) SELECTING RULE The Selecting Rule governs which objects may be selected by the player. Objects are selected from the Field, and placed on the Rack in the order of selection. An example of such a rule is: The player may select any one of the objects in the Field which have not yet been selected.

11) ORDERING RULE This rule must unambiguously define whether two sequentially selected objects have been selected in an acceptable (proper) order. An example of the Ordering Rule is: For {A, B}, B must be greater than or equal to A. Some selected pairs of objects which would fit this rule are {1, 2}, {1, 3}, {2, 6}, and {3, 3}. Conversely {3, 1} and {5, 2} would not fit this rule.

12) TERMINATING RULE The Terminating Rule determines when play ends. It is invoked (or tested) after any object selection. If play is not terminated by this rule, then play continues by having the player make another selection. It is noted that, if the Field is empty (contains no more objects), play terminates automatically. An example of such a rule is: Play ends the second time an object selected by the player is not in proper sequence according to the ordering rule or when seven objects have been placed in the Rack.

13) SCORING RULE The Scoring Rule determines the score to be awarded to the player after play has terminated. Scores may take into account certain properties of the objects themselves, thereby adding an additional element of chance due to the random nature of the dealing rule. If the present invention is being played as a gambling game, the score will equate to a payoff. An example of such a rule is: If play is terminated because a selected object did not fit the ordering rule, then the score is the count of the number of successfully selected objects, not including the selected object which failed the ordering rule. If play is terminated because there were no more objects to select, then the score is two times the Cluster Size. If all the successfully selected objects are the same color, multiply the score by five.

In accordance with a preferred embodiment of the invention, a method of playing an object selection game, includes:

(a) Starting a round of play.

(b) Providing a set of objects, the set of objects containing a plurality of different individual objects, wherein each individual object has an order property in accordance with an ordering rule. In a preferred embodiment, the set of objects is a deck of playing cards, and the ordering rule ranks the cards in accordance with their face value.

(c) Dealing a subset of objects from the set of objects to a player in accordance with a dealing rule. In a preferred embodiment, the objects are dealt so that their order property is hidden.

(d) Revealing a portion of the subset of objects dealt in step (d) to the player in accordance with a revealing rule. In a preferred embodiment, one object is revealed.

(e) The player selecting a previously unselected object from the subset of objects dealt in step (c) in accordance with a selecting rule, and placing the selected object in a playing area adjacent to the last selected object.

(f) After each selection in step (e), using a terminating rule to test whether play shall stop. If "no" returning to step (e) and selecting another object. If "yes" proceeding to step (g).

(g) Computing a score in accordance with a scoring rule. And, (h) ending the round of play.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 24 is a flow chart of a method of playing another card game in accordance with the present invention.

MODES FOR CARRYING OUT THE INVENTION

Figure 1:
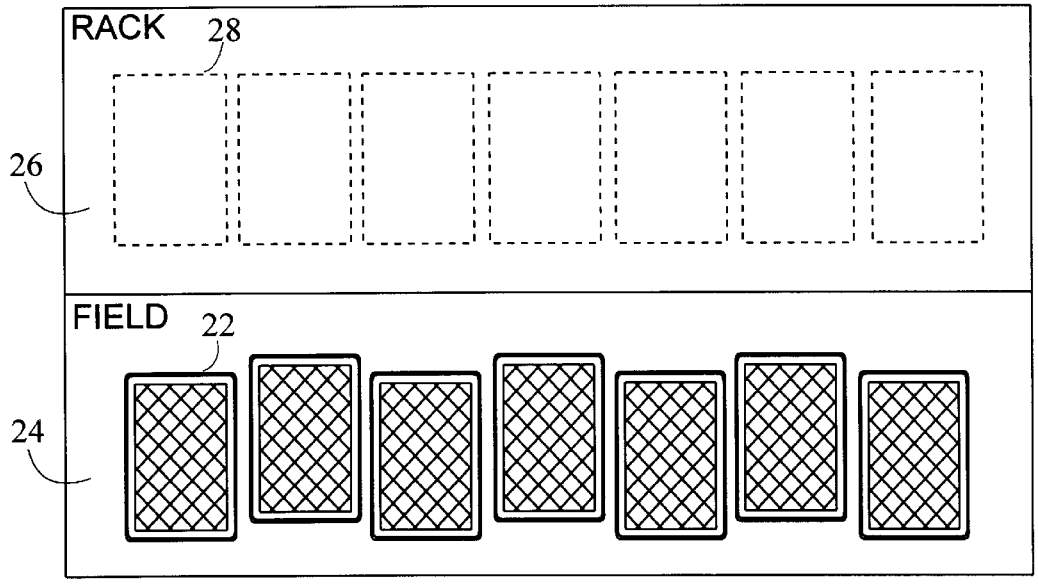
FIG. 1 is a plan view of a first example of an object selection game in accordance with the present invention after objects have been dealt to a player in a dealing area.

Referring initially to FIG. 1, there is illustrated a plan view of a first example of an object selection game in accordance with the present invention after a plurality of seven objects 22 have been dealt face down to a player in a dealing area (field) 24. The dealt objects 22 comprise a seven member subset of a deck of 26 cards (pool) wherein each of the 26 cards has one letter of the alphabet on one side, and a common design on the opposite side or back. The objects are initially dealt in a dealing area (field) 24. The goal of the game is to select objects from the dealing area 24 and place the selected objects in alphabetic order in a playing area (rack) 26. The selection and placement process can continue so long as the last object selected is in alphabetical order with the previously selected object. If the last object selected is not in alphabetical order with the previously selected object, play terminates, and a score is awarded for how many objects have been placed in the proper order. It is noted that the playing area (rack) contains indicia 28 which guide placement of the selected objects.

Figure 2:
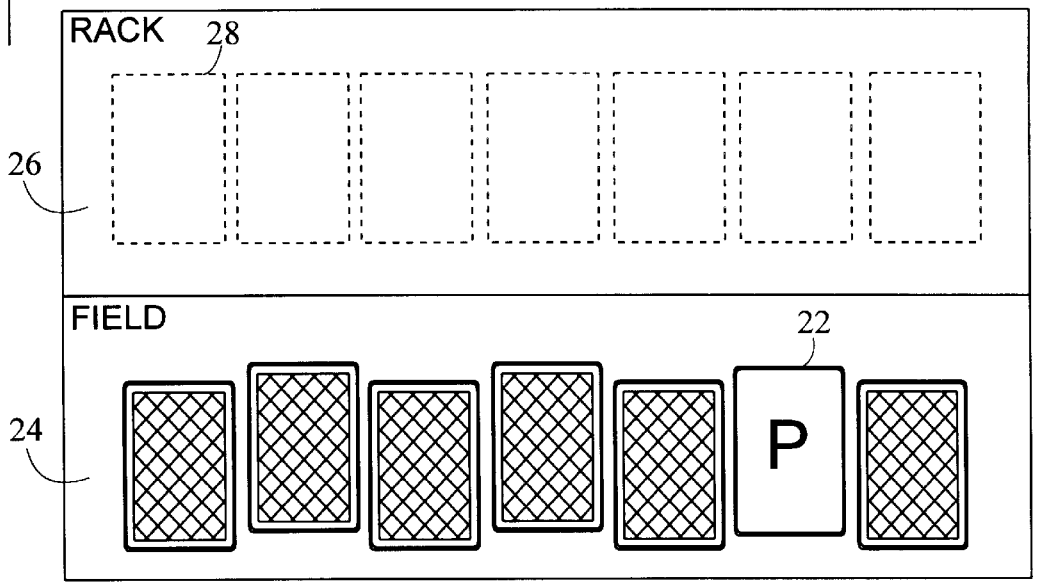
FIG. 2 is a plan view of the object selection game after one object has been revealed to the player.

FIG. 2 is a plan view of the object selection game after one object P has been revealed to the player. In the shown embodiment, the player was free to select any of the field objects 22 to be revealed, and randomly selected the sixth object P. Alternatively, an object 22 can be revealed concurrent with the dealing of the objects 22. For, example the third object 22 could always be revealed by dealing that object face up.

Figure 3:
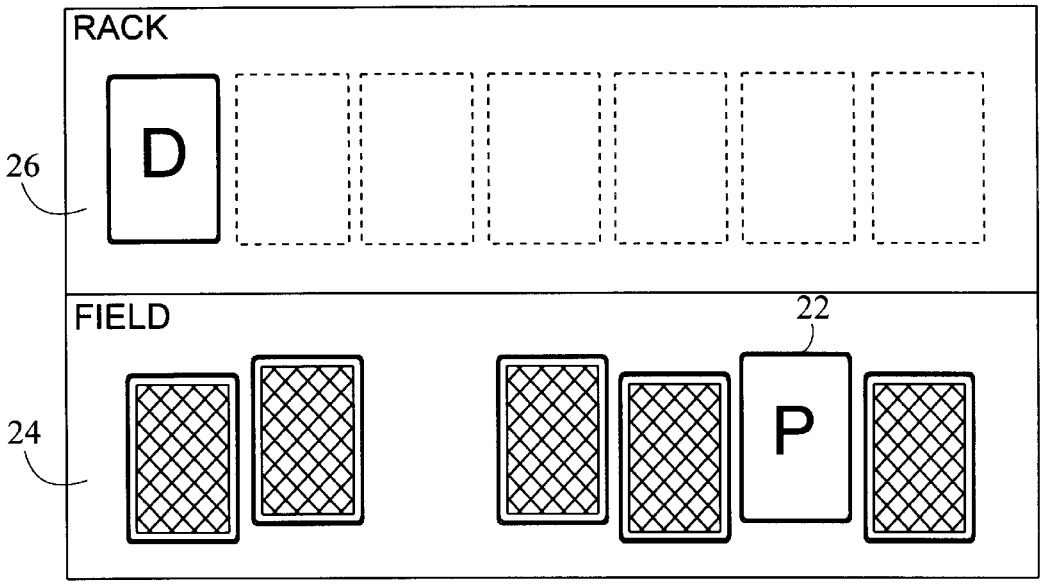
FIG. 3. is a plan view of the object selection game after a first object has been selected by the player and placed in a playing area.

FIG. 3. is a plan view of the object selection game after a first object D has been selected from the dealing area 24 by the player and placed in the playing area 26. Since there are 15 letters before P in the alphabet, the player reasoned that it is likely that one of the other objects 22 will be alphabetically before P. Therefore, the player randomly selected the third object D, and was fortunately correct.

Figure 4:
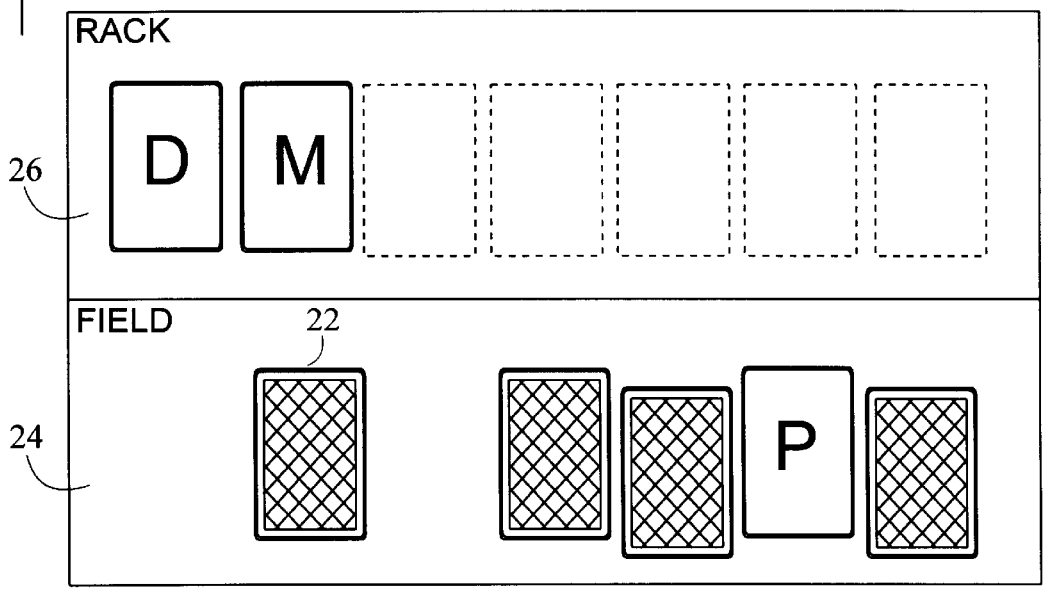
FIG. 4 is a plan view of the object selection game after a second object has been selected by the player and placed in the playing area adjacent to the first selected object.

FIG. 4 is a plan view of the object selection game after a second object M has been selected by the player and placed in the playing area 26 adjacent to the first selected object D. In this step the player reasoned that there are 11 letters between D and P in the alphabet, and 10 other letters after P. The player chose to select an unknown object, randomly selected the first object M, and was again correct.

Figure 5:
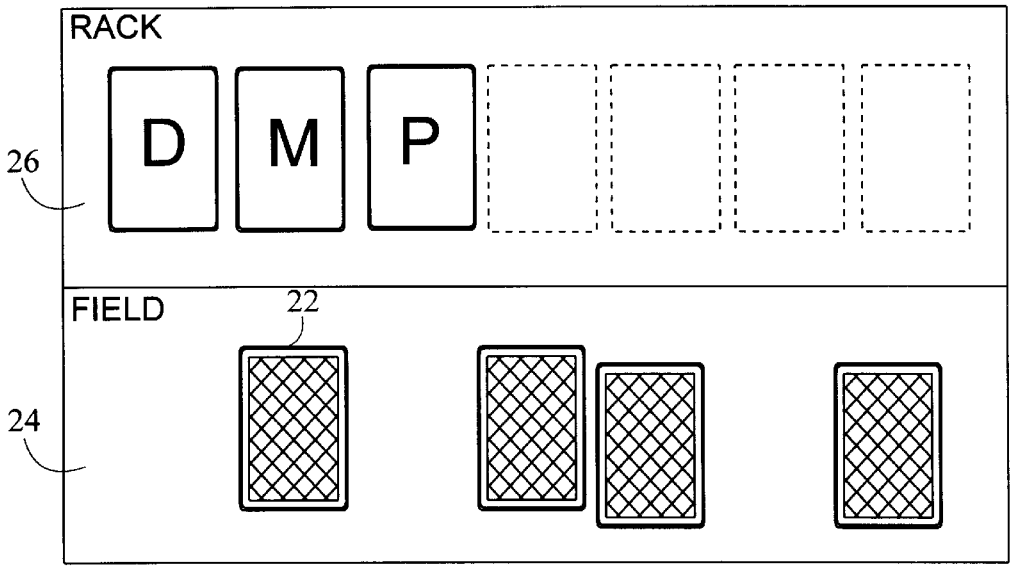
FIG. 5 is plan view of the object selection game after a third object has been selected by the player and placed in the playing area adjacent to the second selected object.

FIG. 5 is plan view of the object selection game after a third object P has been selected by the player and placed in the playing area 26 adjacent to the second selected object M. Since P is very close to M in the alphabet, the player reasoned that this would be a good time to select the originally revealed object P.

Figure 6:
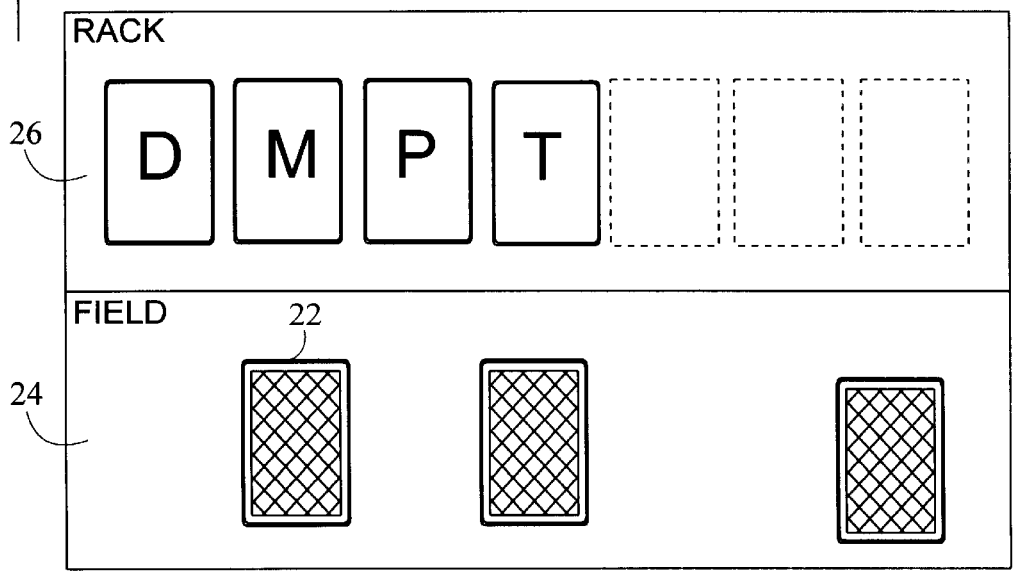
FIG. 6 is a plan view of the object selection game after a fourth object has been selected by the player and placed in the playing area adjacent to the third selected object.

FIG. 6 is a plan view of the object selection game after a fourth object T has been selected by the player and placed in the playing area 26 adjacent to the third selected object P. The player simply randomly selected the fifth object T, and was again correct. The player now has achieved a sequence of four properly ordered objects.

Figure 7:
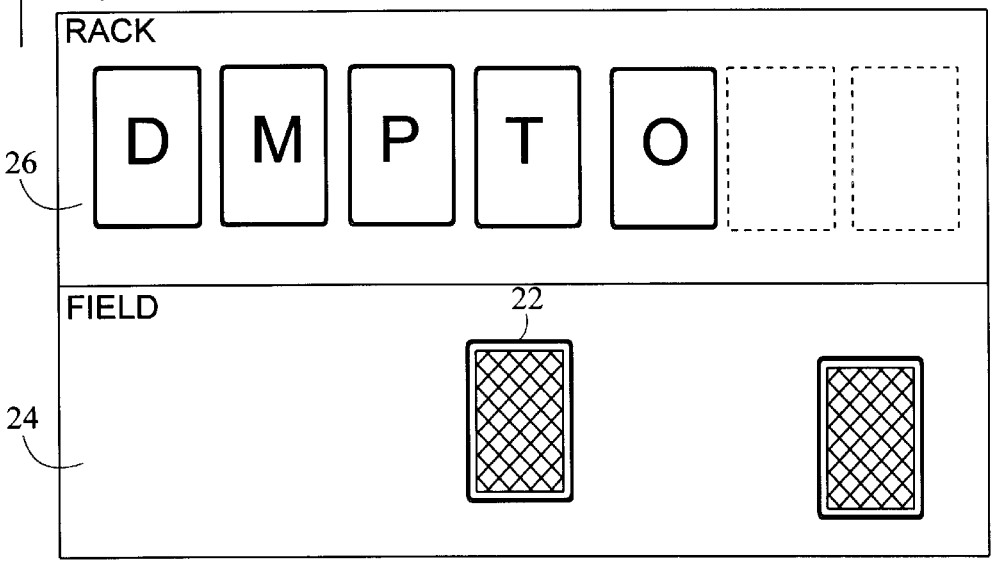
FIG. 7 is a plan view of the object selection game after a fifth object has been selected by the player and placed in the playing area adjacent to the fourth selected object.

FIG. 7 is a plan view of the object selection game after a second object O has been selected by the player and placed in the playing area 26 adjacent to the fourth selected object T. Unfortunately, the previously selected object T and the last selected object O are not in alphabetical order, therefore play is terminated with the player receiving a score of four properly sequenced objects (D, M, P, and T).

Figure 8:
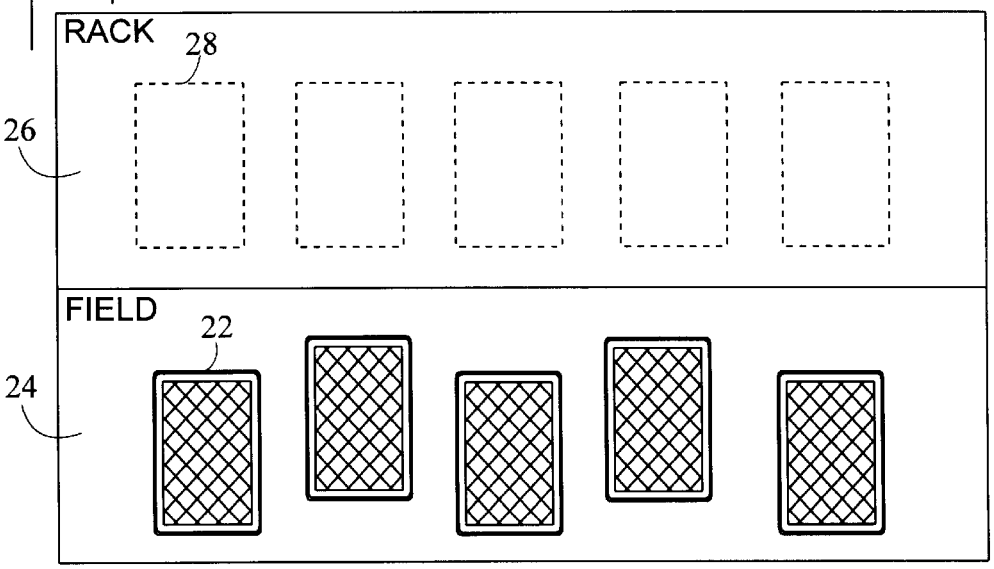
FIG. 8 is a plan view of a second example of an object selection game in accordance with the present invention utilizing playing cards after the cards have been dealt to a player in a dealing area.

FIG. 8 is a plan view of a second example of an object selection game in accordance with the present invention utilizing five playing cards 22 after the cards have been dealt to a player in the dealing area (field) 24. The goal of the game is to select cards 22 from the dealing area 24 and place the selected cards in sequential order 2 through ace (A) in the playing area (rack) 26. If those cards 22 placed in proper order in the playing area 26 contain certain poker hands, then a payoff is awarded.

Figure 9:
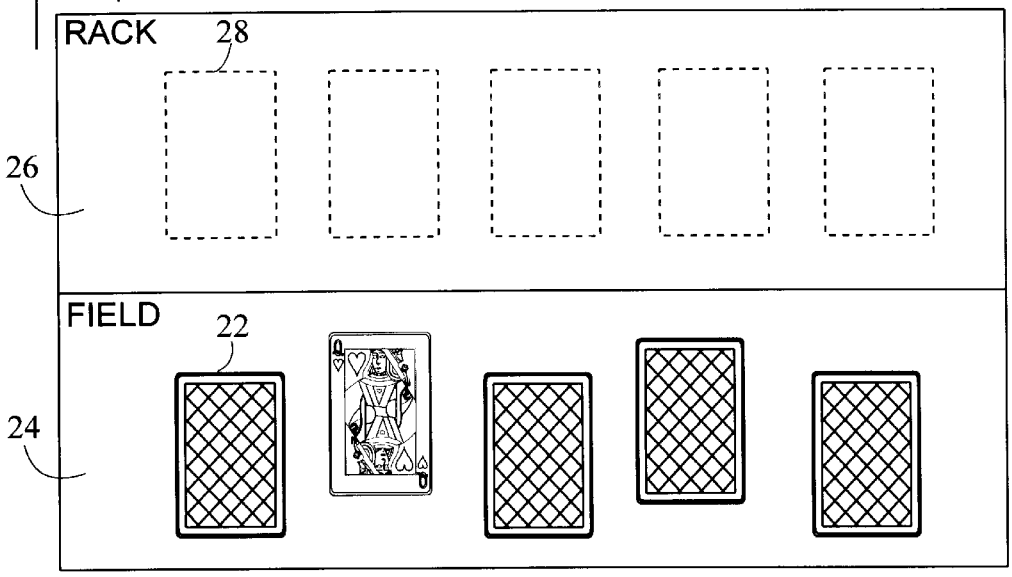
FIG. 9 is a plan view of the object selection game after one card has been revealed to the player.

FIG. 9 is a plan view of the object selection game after one card QH has been revealed to the player.

Figure 10:
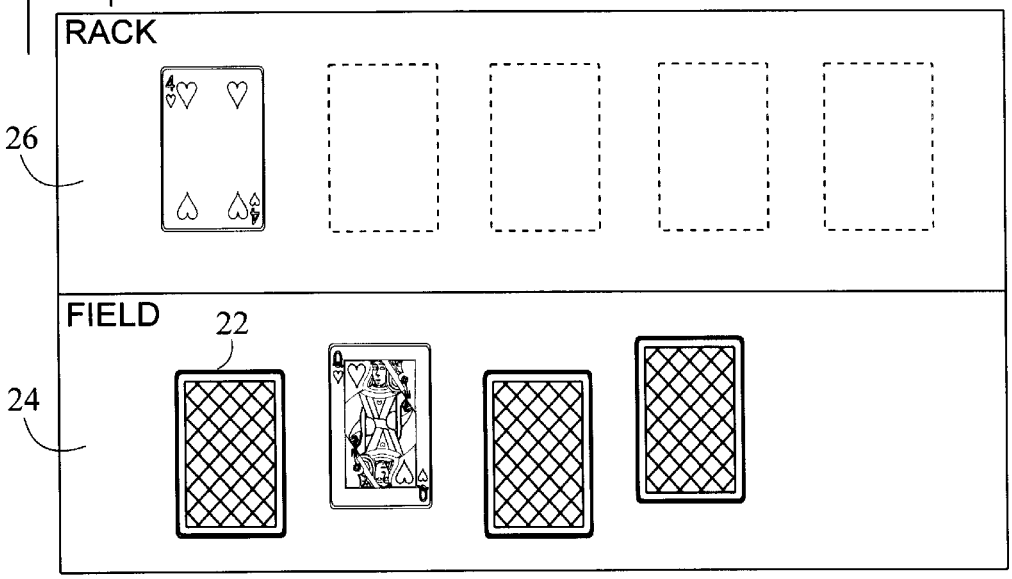
FIG. 10 is a plan view of the object selection game after a first card has been selected by the player and placed in a playing area.

FIG. 10 is a plan view of the object selection game after a first card 4H has been selected by the player and placed in the playing area 26.

Figure 11:
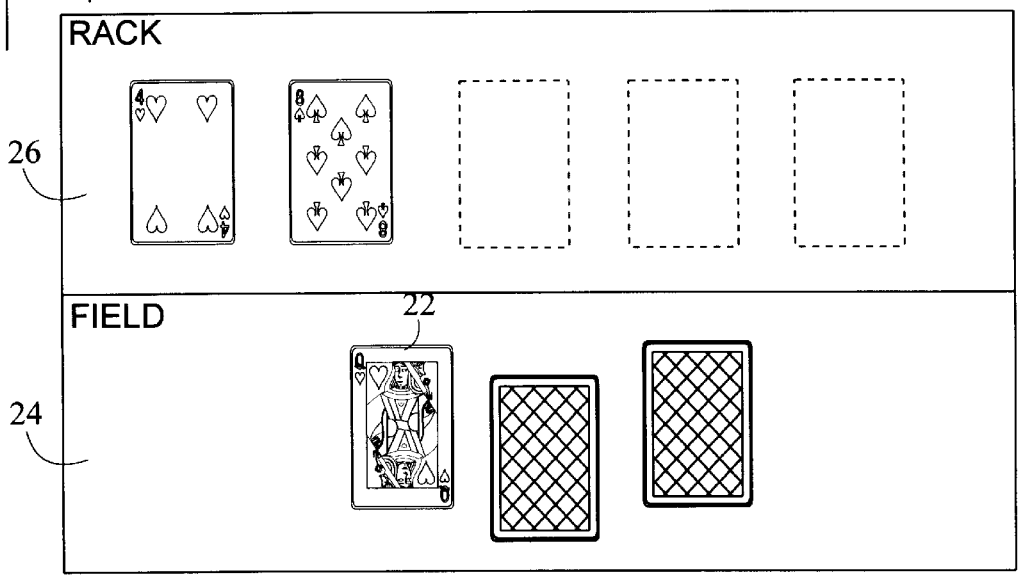
FIG. 11 is a plan view of the object selection game after a second card has been selected by the player and placed in the playing area adjacent to the first selected card.
Figure 12:
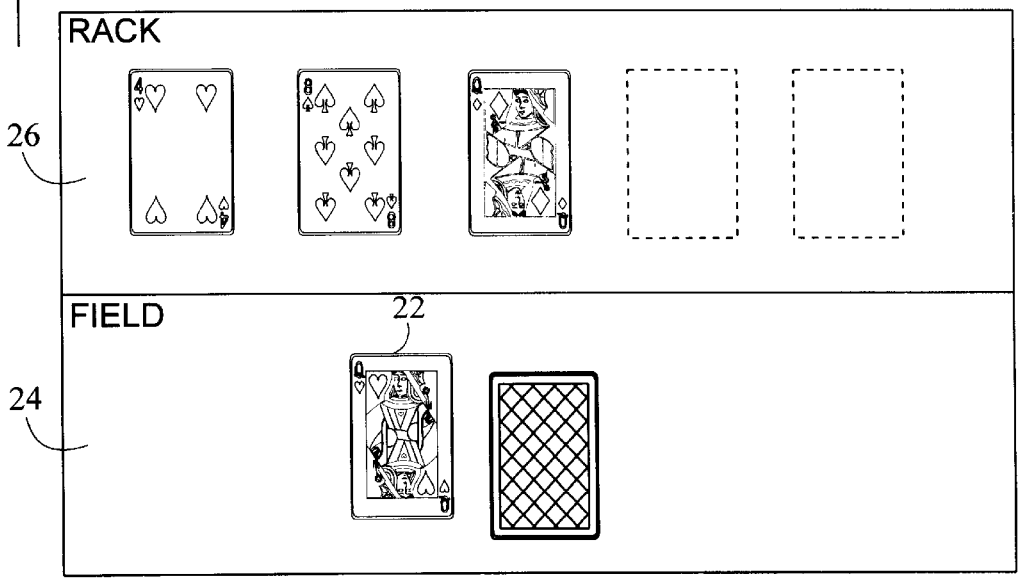
FIG. 12 is plan view of the object selection game after a third card has been selected by the player and placed in the playing area adjacent to the second selected card.
Figure 13:
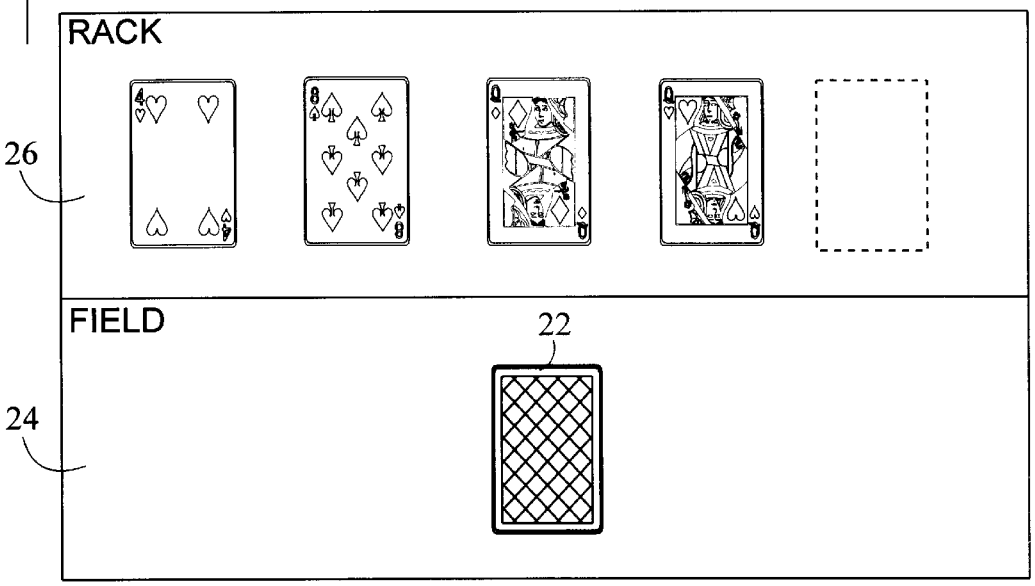
FIG. 13 is a plan view of the object selection game after a fourth card has been selected by the player and placed in the playing area adjacent to the third selected card.

FIG. 11 is a plan view of the object selection game after a second card 8S has been selected by the player and placed in the playing area 26 adjacent to the first selected card 4H;

FIG. 12 is plan view of the object selection game after a third card QD has been selected by the player and placed in the playing area 26 adjacent to the second selected card 8S;

FIG; 13 is a plan view of the object selection game after a fourth card QH has been selected by the player and placed in the playing area adjacent to the third selected card QD. In the shown embodiment, proper sequential order can include two adjacent cards 22 being of the same order value.

Figure 14:
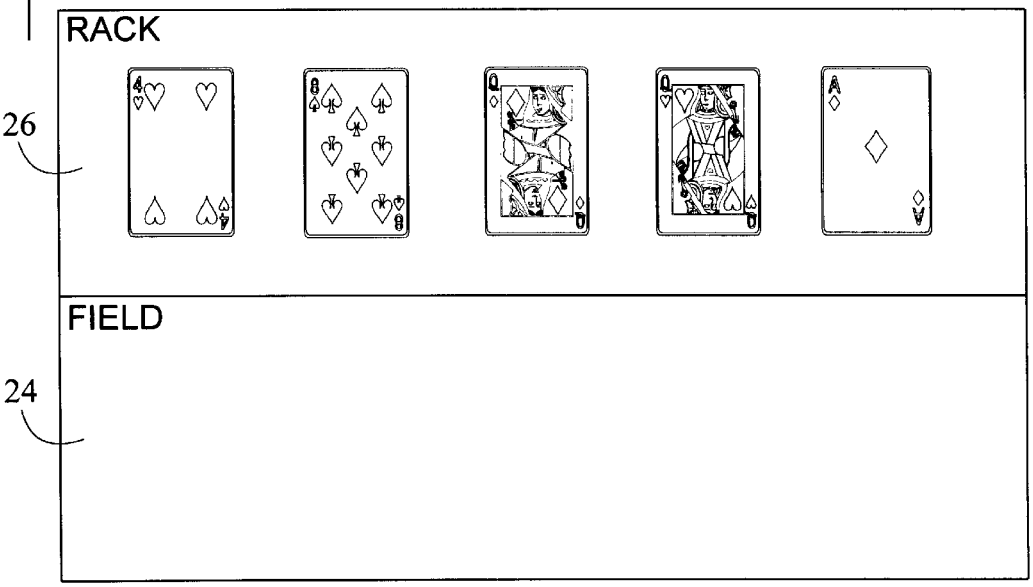
FIG. 14 is a plan view of the object selection game after a fifth card has been selected by the player and placed in the playing area adjacent to the fourth selected card.

FIG. 14 is a plan view of the object selection game after a fifth card AD has been selected by the player and placed in the playing area adjacent to the fourth selected card QH. The game is then terminated because no more cards are available in the dealing area 24 for selection. In this embodiment the player does not receive a score for the five sequential cards, however a score or payoff is awarded for the pair of Queens as in poker.

Figure 15:
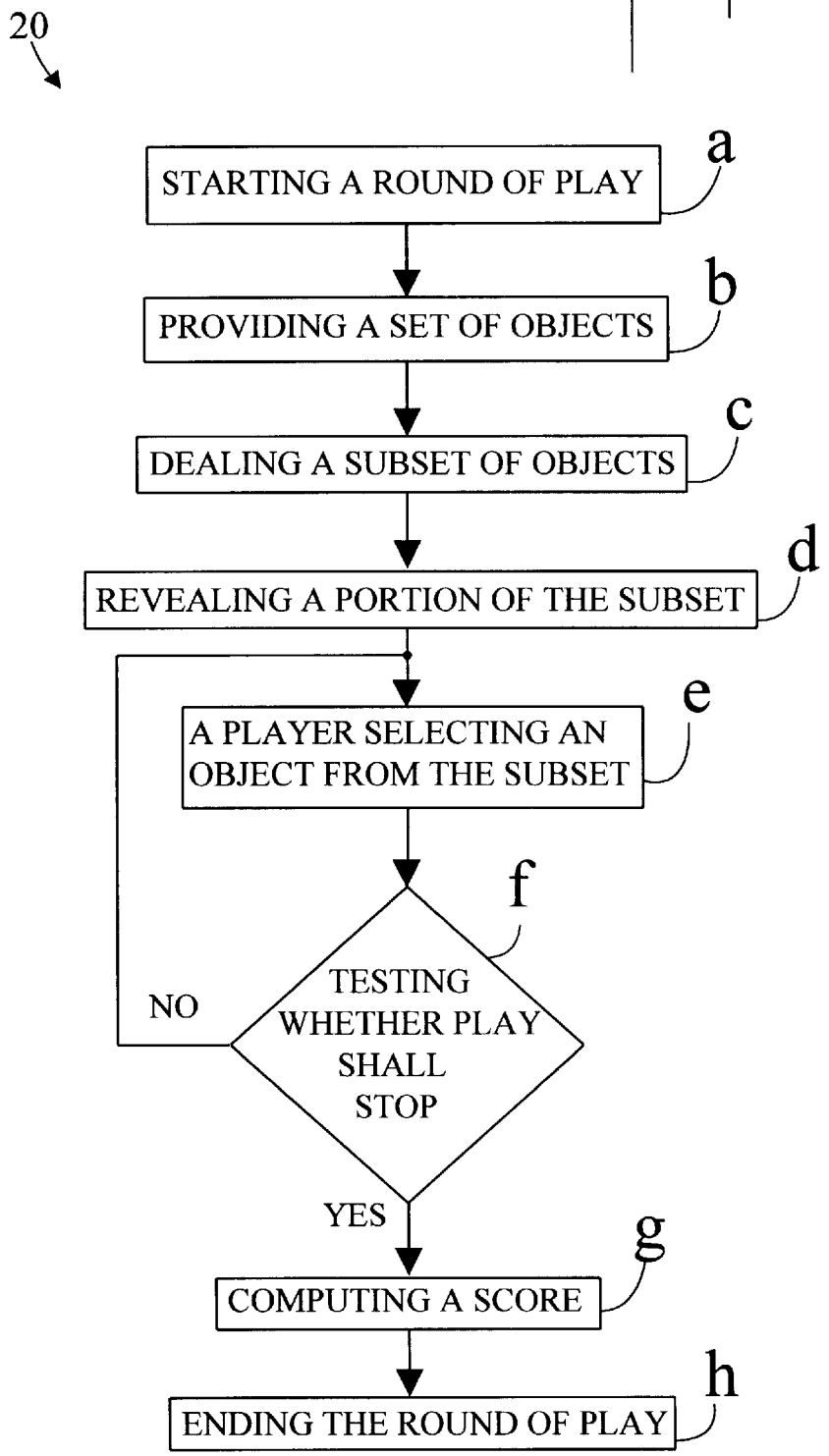
FIG. 15 is a flow chart of a method of playing a selection game in accordance with the present invention.

Now referring to FIG. 15, there is illustrated a method of playing an object selection game in accordance with the present invention, generally designated as 20. An ordering rule, a dealing rule, a revealing rule, a selecting rule, a terminating rule, and a scoring rule govern the play of object selection game 20.

In step (a) a round of play (sometimes referred to as a "hand") is started. It may be appreciated that object selection game 20 may be played by a single player, by a player playing against a gaming establishment, by a plurality of players playing against a gaming establishment, or by a plurality of players playing against each other.

In step (b), a set (pool) of objects is provided, the set of objects containing a plurality of different individual objects, wherein each individual object has an order property in accordance with the ordering rule. The ordering rule defines any desired proper sequential order of the objects, wherein the individual objects are ranked according to their order properties. For example, the ordering rule could state that the proper sequential order of the objects is any of the following:

increasing numerical value;

decreasing numerical value;

equal or increasing numerical value;

equal or decreasing numerical value;

alphabetical;

reverse alphabetical;

increasing card value ace through king;

decreasing card value king though ace;

equal or increasing card value ace through king;

equal or decreasing card value king through ace;

increasing card value two through ace;

decreasing card value ace though two;

equal or increasing card value two through ace; and, equal or decreasing card value ace through two.

If the set of objects was 10 tiles labeled 1 through 10, proper sequential order as defined by the ordering rule could be 1 through 10, or 10 through 1. A less conventional ordering of 1, 3, 5, 7, 9, 2, 4, 6, 8, and 10 could also be employed. Similarly, if the set of objects was 26 blocks labeled A through Z, proper sequential order as defined by the ordering rule could be A through Z, or Z through A. Or the ordering rule could be intransitive as in "rock breaks scissors, scissors cut paper, and paper covers rock". The options are virtually endless. The ordering rule simply defines the proper sequential order of the objects. If the set of objects contains individual objects having equal order ranking (for example a deck of playing cards wherein there are four of each rank), then the proper sequential order can embrace either (1) equal or increasing value, or (2) equal or decreasing value. For example, the sequence 4, 6, 9, 9, Jack could be allowable for increasing value, and the sequence Queen, 7, 7, 7, 3 could be allowable for decreasing value. This feature is important in a poker variation of the present invention, in that it allows pairs, three of a kind, and four of a kind sequences.

In a preferred embodiment of the invention, the order property of each individual object is capable of being hidden (hiding means). For example, a deck of playing cards wherein the face of each card may be turned down to present a common back.

In step (c), a subset (cluster) of objects from the set (pool) of objects is dealt to a player in accordance with the dealing rule. As used herein, the term "dealing" is not limited to cards, but rather defines any means of distributing the objects. In a preferred embodiment, the dealt objects are placed in a dealing area (field). The dealing rule defines the number (cluster size) of objects in the subset (cluster) of objects (e.g. 7 in FIG. 1), and can also state the manner in which the subset of objects is dealt. For example, the dealing rule could state that all of the subset of objects be dealt so that the order property is hidden (e.g. all cards being dealt face down). Alternatively, the dealing rule (in conjunction with the revealing rule) could state that one of the subset of objects be revealed during the deal. For example, dealing the fourth card out of five face up. In another possible embodiment, the dealing rule states that from time to time after the original subset of objects is dealt in step (c), additional objects may be dealt during the course of play. For example, if an Ace is selected then an additional object is dealt face up in the dealing area.

It may be appreciated that object selection game 20 may be played as a gambling game, wherein sometime before step (d) the player places a monetary wager. Alternatively, the game may simply be played for recreation wherein no money is involved.

In step (d) a portion of the subset of objects dealt in step (c) is revealed to the player in accordance with the revealing rule. The revealing rule governs the revealing of objects to the player prior to or during the play of object selection game 20. When an object or objects are revealed to the player, it gives the player information and therefore affords the player more options in the play of the game. Possible revealing rules are:

- either (1) zero, (2) one, or (3) more than one object of the subset of objects are revealed to the player;
- revealing occurs during the dealing of the subset of objects;
- revealing occurs after the dealing of the subset of objects; and,
- the player choosing the objects to be revealed.

Figure 17:
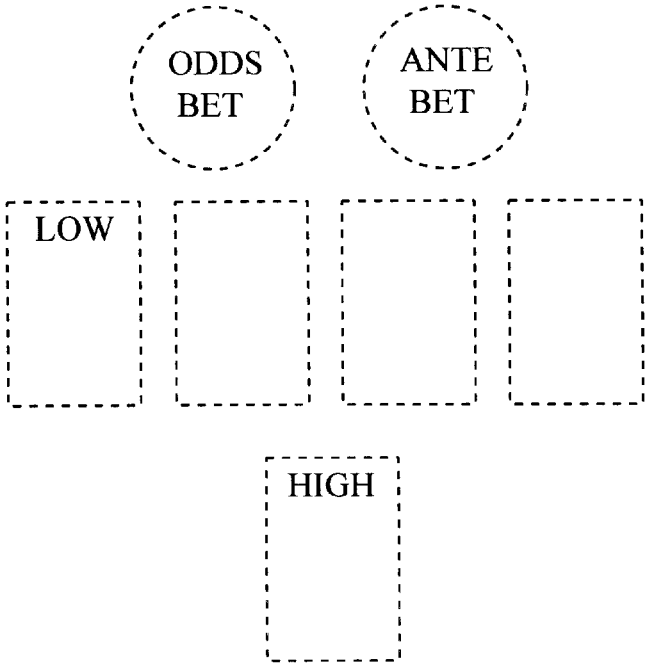
FIG. 17 is a plan view of a third example of an object selection game in accordance with the present invention. The playing area includes five positions labeled Low to High in which playing cards are placed.

In step (e) the player selects a previously unselected object from the subset of objects dealt in step (c) in accordance with the selecting rule. That is, the player may select any object from the subset of objects which has not previously been selected. In a preferred embodiment, after the player selects an object, the player places the selected object in a playing area (rack) so that the order property is visible. For subsequent selections, the player places the last selected object adjacent to the next to last selected object in the playing area. In a preferred embodiment, indicia marks the position in which that objects are to be placed in the playing area (refer to FIG. 1). The term "adjacent" means sequentially adjacent (next in line), and does not absolutely require that the objects be physically adjacent. Refer to FIG. 17 wherein one position (High) has been offset to accommodate physical size constraints of a playing table. In a preferred embodiment, if multiple players are playing, after a player makes a selection, play then passes to the next sequential player. This is repeated until play is terminated for all players in accordance with the terminating rule (see step (f) below).

In step (f), after each selection in step (e), the terminating rule is used to test whether play shall stop. In a preferred embodiment, the terminating rule tests whether after each selection in step (e), either (1) the last two objects selected in step (e) are not in proper sequential order, or (2) all of the subset of objects dealt in step (c) have been selected. If either (1) or (2) is true, play is stopped. That is, in step (f), if the answer is "no", the player returns to step (f) and makes another selection. In step (f) if the answer is "yes", play is terminated, and the game proceeds to step (g) wherein a score is computed. It is noted however, that in another embodiment, the terminating rule could terminate play before all of the dealt subset of objects have been selected. For example, seven objects are dealt in the dealing area, however only five of those objects can be selected and placed in the playing area. In another possible embodiment, the terminating rule states: a selected object is compared with more than one previously selected object in accordance with the ordering rule. For example, the ordering rule might state that the selected objects must spell a word in the order selected. Therefore, the terminating rule could require that after the first selection, each time an object, in this case a letter, is selected, it must comprise the last letter in a word (such as B,E,T).

In step (g) a score for the round of play is computed in accordance with the scoring rule. In a preferred embodiment, the scoring rule states that the player shall receive a score according to how many objects are selected in proper sequential order prior to observing a "yes" in step (f), (that is before the round of play is terminated by the terminating rule). For example, if five objects were dealt, and the player properly placed the first four objects in proper sequential order, then a score of four would be awarded. It may be appreciated that the score could comprise a monetary payoff if the player has placed a wager. In another preferred embodiment, the scoring rule states that the player shall receive a score if certain combinations of objects are selected prior to observing a "yes" in step (f). For example, if the set of objects is a deck of playing cards, a score could be awarded for selecting two Jacks, three of a kind, a straight, etc. It is noted however, that if the game was terminated because a proper sequence was not observed, and one of the Jacks was in the field yet to be selected, no score would be awarded. In another possible embodiment however, after play is terminated a score could be awarded even if all objects were not selected in the proper sequential order. For example, if a player is dealt a Royal flush, a score could be awarded regardless of the order in which cards were selected. In another embodiment of the invention, the scoring rule states that the player shall receive a score if a certain object is selected. For example, a score will be awarded if any Queen is selected.

In step (h), the round of play of object selection game 20 is ended.

Figure 16:
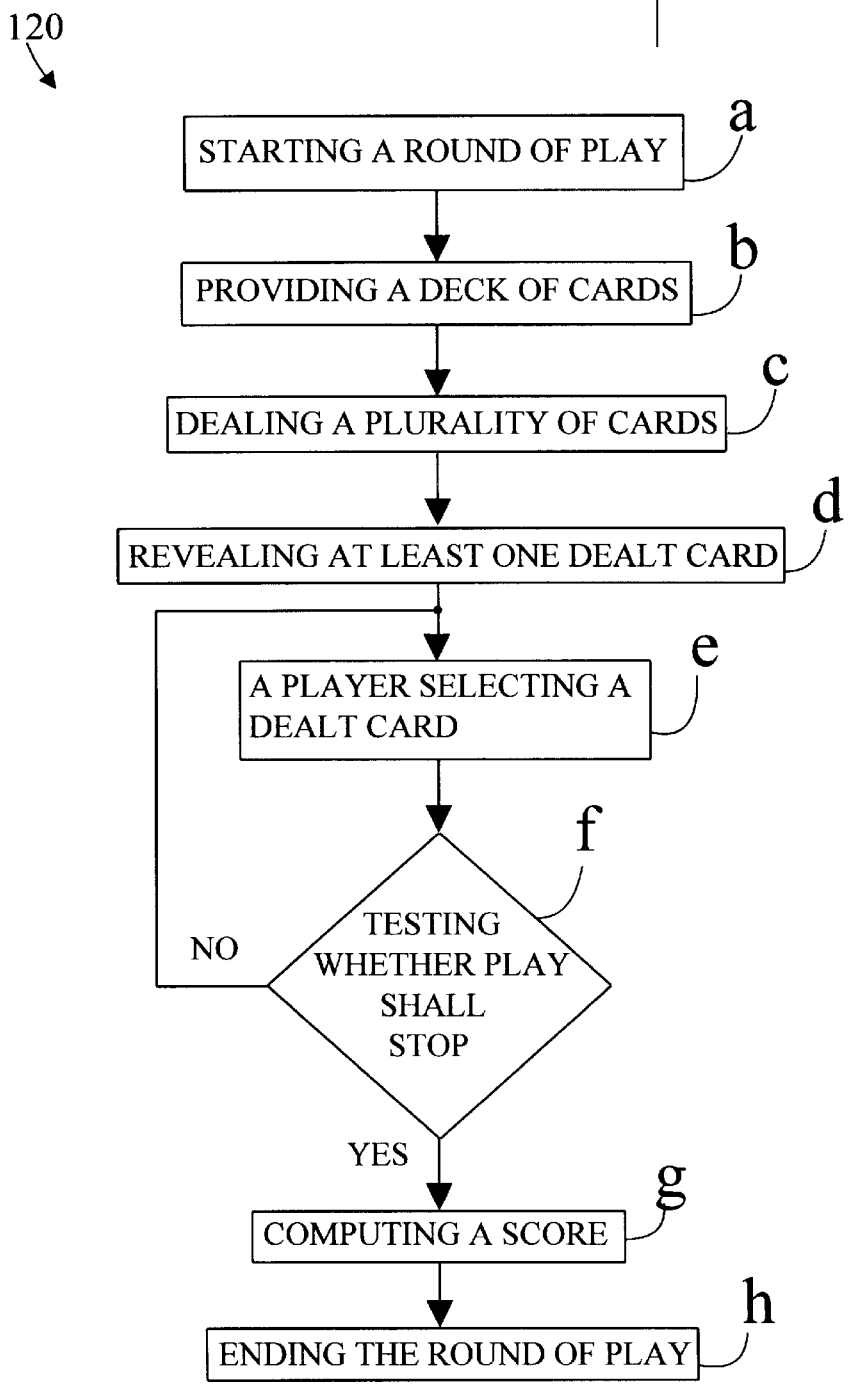
FIG. 16 is a flow chart of a method of playing a card game in accordance with the present invention.

Now referring to FIG. 16, there is illustrated a method of playing a card game in accordance with the present invention, generally designated as 120. Method 120 is a specific variation of method 20, wherein the set of objects is a deck of playing cards, and the scoring of the player's hand is based upon the game of poker. A preferred name for method 120 is "Sequence Stud".

In step (a) a round of play is started. It may be appreciated that card game 120 may be played by a single player, by a player playing against a gaming establishment, by a plurality of players playing against a gaming establishment, or by a plurality of players playing against each other.

In step (b) a deck of playing cards is provided, wherein each individual playing card has an order property in accordance with an ordering rule. The deck of playing cards could include a conventional deck of 52 cards. Or alternatively, the deck could include at least one of (1) multiple decks of playing cards, (2) additional cards added to the deck of playing cards, (3) certain cards removed from the deck of playing cards, (4) one or more jokers which can be used as an ace, or as a wild card in straights and flushes, and (5) certain cards in the deck of playing cards being designated as wild, wherein the wild card can assume any order property desired by the player. The ordering rule could state that the proper sequential order of the cards is any of the following:

increasing card value ace through king;

decreasing card value king though ace;

equal or increasing card value ace through king;

equal or decreasing card value king through ace;

increasing card value two through ace;

decreasing card value ace though two;

equal or increasing card value two through ace; and, equal or decreasing card value ace through two.

In step (c), a plurality of playing cards from the deck are dealt to a player in accordance with a dealing rule. In a preferred embodiment, either five, six, or seven cards are dealt to the player in accordance with poker convention. Other aspects of the dealing rule has been previously discussed under method 20.

The card game 120 may be played as a gambling game, wherein sometime before step (d) the player places a wager. Alternatively, the game may simply be played for recreation wherein no money is involved.

In step (d), at least one of the cards dealt in step (c) are revealed to the player in accordance with a revealing rule. Other possible revealing rules are:

revealing occurs during the dealing of the plurality of playing cards;

revealing occurs after the dealing of the plurality of playing cards; and, the player choosing the cards to be revealed.

In step (e), the player selects any previously unselected card dealt in step (c), and places the selected card in the playing area (rack), In step (f), after each selection in step (e), it is observed whether either (1)) the last two cards selected in step (e) are not in proper sequential order in accordance the ordering rule, or (2) all of the subset of objects dealt in step (c) have been selected. If the answer is "no", returning to step (e) and selecting another card. If the answer is "yes", play is stopped, and the game proceeds to step (g) where a score is computed.

In step (g), a score (payoff if playing a wagering game) for the round of play is computed in accordance with a scoring rule. Scoring in game 120 is based upon the value of poker hands. In a preferred embodiment, the scoring rule states that the player shall receive a score for one of the following prior to observing a "yes" in step (f), (that is prior to terminating play):

one pair jacks or better;

two pair;

three of a kind;

straight;

flush;

full house four of a kind;

straight flush; and, royal flush.

It can be appreciated that the scores differ for various hands. For example, a full house would be awarded a higher score (or payoff) than a pair of Kings. In a preferred scoring embodiment, the score (payoff) is a multiple of the player's wager. For example, a pair of Jacks, Queens, or Kings would pay two times the player's wager, or three of a kind would pay four times the player's wager, etc.

In another scoring embodiment, in step (g) all of the dealt cards are exposed, including the cards remaining in the dealing area after play is stopped by the terminating rule. If the dealt cards in step (c) form one of a straight, a flush, a straight flush, or a royal flush, the player receives a score even if the dealt cards were not selected in proper sequential order, or if play was stopped by the terminating rule.

In another scoring embodiment, in step (g) all of the dealt cards are exposed. If the dealt cards form one of a straight, a flush, a straight flush, or a royal flush, and the first card selected in step (e) is the lowest ranking of the dealt cards, the player receives a score even if the dealt cards were not selected in the proper sequential order, or if play ws stopped by the terminating rule. If the game is being played on an electronic device, a correct selection of the first card in the sequence will result in all five cards being automatically moved to the playing area in the correct sequence. This function is called Auto-Play. The round of play will be scored with a straight, flush, straight flush, or royal flush, as appropriate.

In another scoring embodiment, in step (g) all of the dealt cards are exposed. If the dealt cards form one of a straight, a flush, a straight flush, or a royal flush, and the first and second cards selected in step (e) are in proper sequential order, the player receives a score even if all the dealt cards were not selected in the proper sequential order, or if play was stopped by the terminating rule.

In another scoring embodiment, in step (g) all of the dealt cards are exposed. If the dealt cards form one of a straight, a flush, a straight flush, or a royal flush, and the first, second, and third cards selected in step (e) are in proper sequential order, the player receives a score even if all the dealt cards were not selected in the proper sequential order, or if play was stopped by the terminating rule.

In another scoring embodiment, the scoring rule states that the player shall receive a score for one of the following prior to observing a "yes" in step (f):

sequence of three;

sequence of four; and sequence of five.

In step (h), the round of play of card game 120 is ended.

EXAMPLES OF "SEQUENCE STUD"

The following examples of rounds of play (hands) demonstrate the general principles of embodiment 20, and the specific principles of embodiment 120. The conditions for the examples are:

The set (pool) consists of a standard deck of 52 playing cards to which one Joker has been added.

The ordering rule is equal or increasing value 2 through Ace. The Joker may be used as an Ace, or as a wild card in straights and flushes. 2's (deuces) are wild and may be assume any value at the discretion of the player.

The dealing rule is dealing a five card subset (cluster) face down in a dealing area.

The revealing rule is that a player reveals one of the five cards.

The selecting rule is that the player may select any card in the dealing area and place the selected card in the playing area next to the last previously selected card.

The terminating rule is stop play the first time a selection fails the ordering rule, or when the field is empty.

The scoring rule is award a score (payoff) if the player achieves any of the following hands before play is stopped by the terminating rule:

one pair jacks or better;
two pair;
three of a kind;
straight;
flush;
full house;
four of a kind;
straight flush; and,
royal flush.

The scoring rule further states that if the five dealt cards form a straight, flush, a straight flush, or a Royal Flush, a score (payoff) is awarded if the lowest ranking card was selected first, even if the other selections were not in proper sequential order, or if play was stopped by the terminating rule.

Note: The card in bold is the revealed card. S=spades, H=hearts, D=diamonds, and C=clubs.

Round of Play #1

5S, 7D, 4H

Result—the third selected card was out of sequence, no score.

Round of Play #2

4D, 10S, QD, QH, 3C

Result—the fifth selected card was out of sequence, score for two Queens.

Round of Play #3

8H, 10D, JH, KC, AS

Result—all selected cards were in sequence, but no score.

Round of Play #4

3S, 6H, 9C, 2D, KD

Result—all selected cards were in sequence (the 2 is wild), score for two Kings.

Round of Play #5

5S, 7S, 7D, QH, 2C

Result—all selected cards were in sequence, score for three 7's.

Round of Play #6

3S, 8S, 10S, Joker, AS

Result—all selected cards were in sequence, score for a flush.

Round of Play #7

4D, 8D, 10D, JD, 3D

Result—the fifth selected card was out of sequence, no score even though all cards are diamonds, since the lowest ranking card was not selected first.

Round of Play #8

4S, 8H, JH, AD, Joker

Result—all selected cards were in sequence, score for two Aces.

Round of Play #9

7H, 8S, 9C, 10D, JH

Result—all selected cards were in sequence, score for a straight.

Round of Play #10

5D, JD, QD, 6D, KD

Result—the fourth card was out of sequence, however score for a flush since the first card selected was the lowest ranking.

Now referring to FIG. 17, there is illustrated a plan view of a third example of an object selection game in accordance with the present invention. The playing area includes five positions or boxes labeled "Low" to "High" in which playing cards 22 are placed. The goal of the game is to select cards 22 and place the selected cards 22 in proper sequential order from low to high in the positions indicated. If the cards 22 placed in proper sequential order contain certain poker hands, and if an "odds" wager is placed, then a score or payoff from the house is awarded. A score or payoff (from either the house, or from other players) can also be awarded even if the cards 22 are not placed in the proper sequential order, and an "ante" wager was placed. The "Odds" Bet and "Ante" Bet positions are for "odds" and "ante" wagers that the player makes. It may be appreciated that the names of these wagers could be changed.

Figure 18:
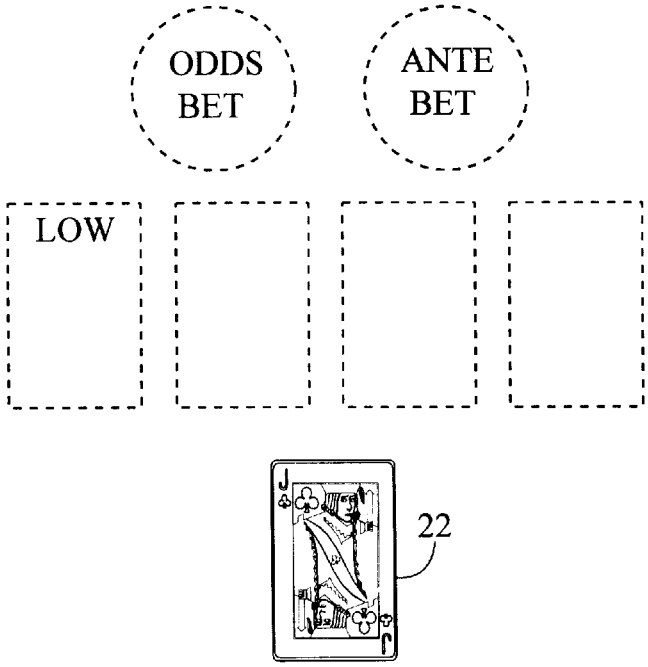
FIG. 18 is a view after one card has been dealt and revealed to the player.

FIG. 18 is a plan view of the object selection game after one card JC has been dealt and revealed to the player. The first dealt card is always placed in the High position. The player then has the option of selecting the dealt card JC and placing it in the Low position, or alternatively selecting (having a card dealt) from the deck and placing that card 22 in the Low position.

Figure 19:
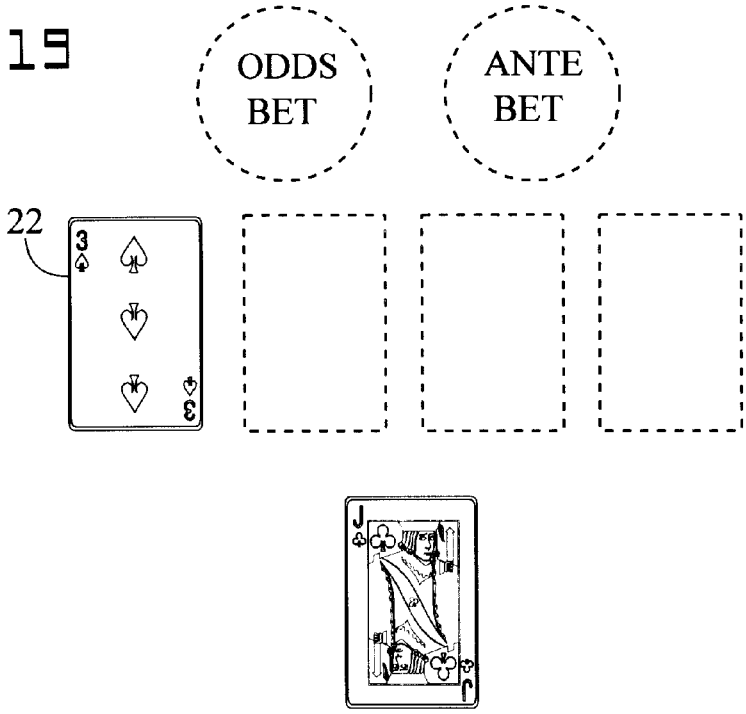
FIG. 19 is a view after the player has selected a card to dealt from the deck and placed in a Low position.

FIG. 19 is a plan view of the object selection game after a first card 3H has been selected from the deck and placed in the Low position. Since the JC is relatively high, the player correctly elected to have a card 22 from the top of the deck placed in the Low position.

Figure 20:
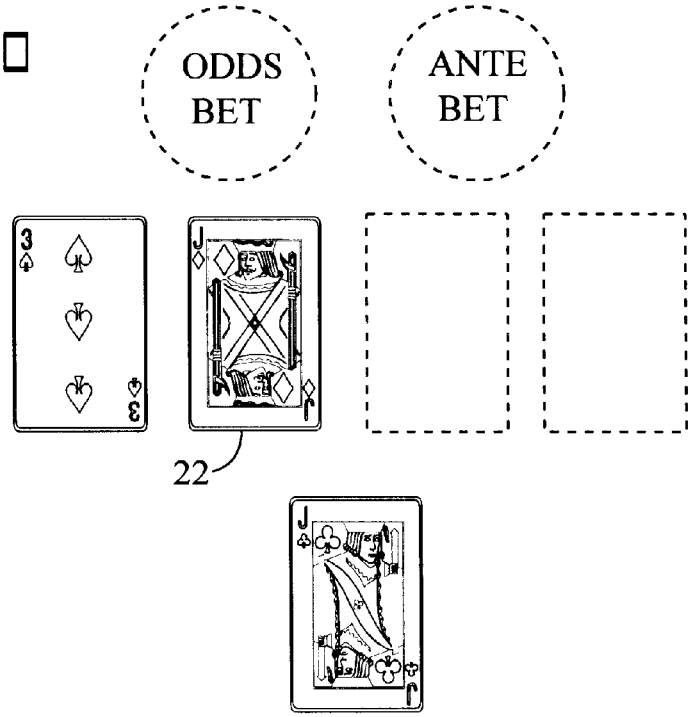
FIG. 20 is a view after the player has selected a second card be dealt from the deck and placed adjacent to the first selected card.

FIG. 20 is a plan view of the object selection game after a second card JD has selected from the deck and placed adjacent to the previously selected 3H.

Figure 21:
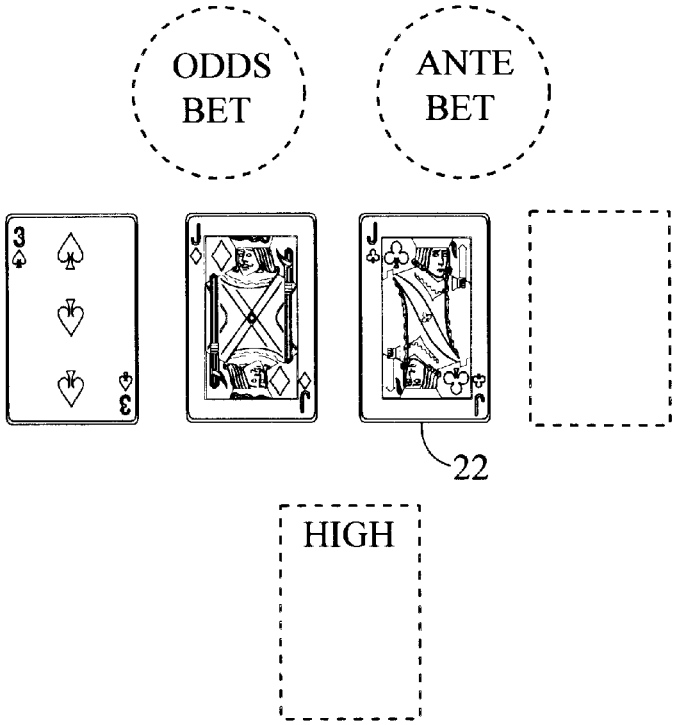
FIG. 21 is a view after the player has selected the originally dealt card and placed it adjacent to the second selected card.

FIG. 21 is plan view of the object selection game after the player has placed the JC adjacent to the JD. Proper sequential order includes equal or increasing value, so all three cards 22 are in proper sequential order.

Figure 22:
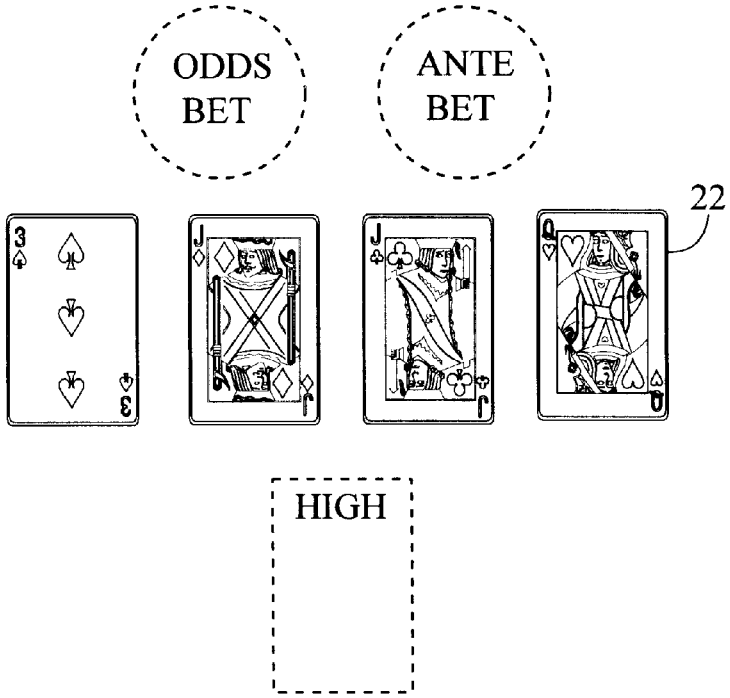
FIG. 22 is a view after the player has selected a fourth card be dealt from the deck and placed adjacent to the third card.

FIG. 22 is a plan view of the object selection game after a fourth card QH has been selected from the deck and placed adjacent to the JC. Since the player previously played the originally dealt JC, cards 22 are now simply sequentially selected from the deck until the predetermined number of five cards have been selected.

Figure 23:
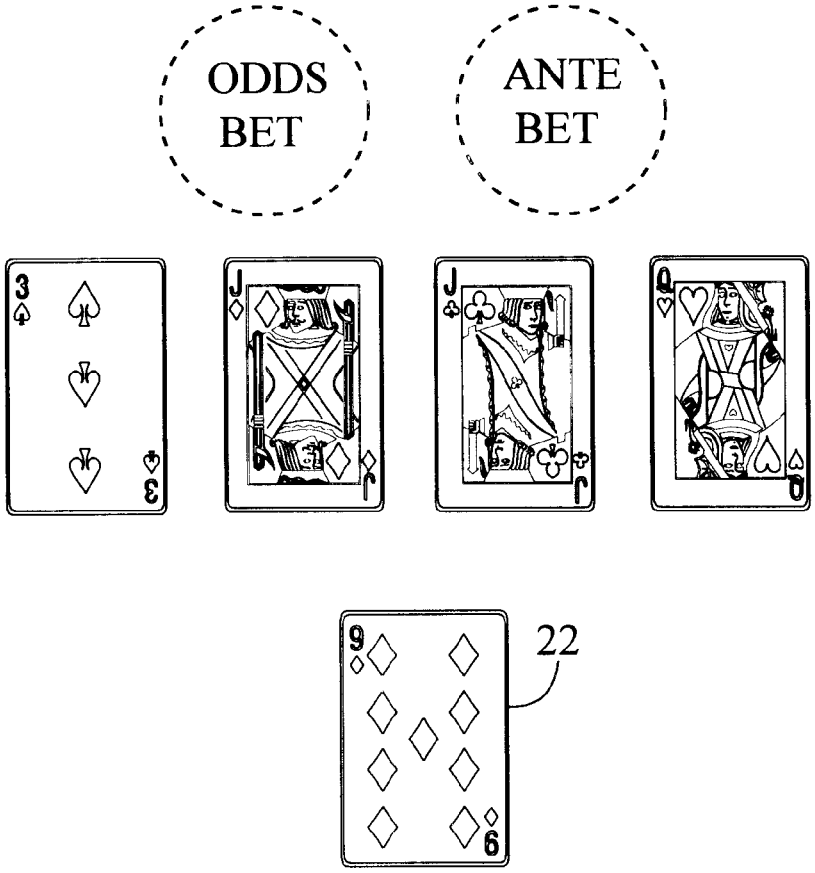
FIG. 23 is a view after a fifth card has been dealt from the deck.

FIG. 23 is a plan view of the object selection game after a fifth card 9D has been selected from the deck and placed in the only remaining High position. It is noted that the 9D is not in proper sequential order, therefore commencing with the first card selected (3H) four cards 22 were selected in proper sequential order. Also, it is noted that play stops since a predetermined number of cards 22 (five in this case) have been selected. In this example, the player, if he placed an "odds" wager, would receive a score (payoff) for the pair of Jacks. If the player also placed an "ante" wager, he would also win the "ante" wagers of all other players if the pair of Jacks was the highest poker hand.

Now referring to FIG. 24, there is illustrated a method of playing a card game in accordance with the present invention, generally designated as 220. Method 220 is a specific variation of method 20, wherein the set of objects is a deck of playing cards, and the scoring of the player's hand is based upon the game of poker. A preferred name for method 220 is "Million $ Stud".

In step (a) a round of play is started. It may be appreciated that card game 220 may be played by a single player, by a player playing against a gaming establishment, by a plurality of players playing against a gaming establishment, or by a plurality of players playing against each other. For "odds" wagers, players play against the dealer of the gaming establishement (house). Also, it is noted that a dealer may either (1) place an "ante" wager, or (2) not place an "ante" wager.

In step (b) a deck of playing cards is provided, wherein each individual playing card has an order property in accordance with an ordering rule. The deck of playing cards could include a conventional deck of 52 cards. Or alternatively, the deck could include at least one of (1) multiple decks of playing cards, (2) additional cards added to the deck of playing cards, (3) certain cards removed from the deck of playing cards, (4) one or more jokers which can be used as an ace, or as a wild card in straights and flushes, and (5) certain cards in the deck of playing cards being designated as wild, wherein the wild card can assume any order property desired by the player. The ordering rule could state that the proper sequential order of the cards is any of the following:

increasing card value ace through king;

decreasing card value king though ace;

equal or increasing card value ace through king;

equal or decreasing card value king through ace;

increasing card value two through ace;

decreasing card value ace though two;

equal or increasing card value two through ace; and, equal or decreasing card value ace through two.

In step (c), at least one card from the deck is initially dealt to a player in accordance with a dealing rule. In a preferred embodiment, one card is dealt either face up or face down to the player and placed in a designated location in a playing area (High position, refer to FIG. 18). However, it is noted that more than one card could also be dealt to the player.

Card game 220 may be played as a gambling game, wherein sometime before step (d) the player places at least one wager. In a preferred embodiment two wagers are placed, and "odds" wager and an "ante" wager. The "odds" wager and the "ante" wager have different payoffs in accordance with the scoring rule. Alternatively, the game may simply be played for recreation wherein no money is involved.

In step (d), at least one of the cards dealt in step (c) are revealed to the player in accordance with a revealing rule. In a preferred embodiment, one card is both originally dealt and revealed to the player, that card being placed in the High position in the playing area.

In step (e), the player has the option of selecting either (1) a card dealt in step (c) if that card has not been previously selected, or (2) a card from the deck of playing cards, and placing the selected card face up in the Low position in the playing area.

In step (f), after each selection, observing whether a predetermined number of cards have been selected. If the answer is "no", returning to step (e) and selecting another card from the top of the deck. If the answer is "yes", play is stopped, and the game proceeds to step (g). In a preferred embodiment, the predetermined number of cards is either five, six, or seven.

In step (g), commencing with the first card selected in step (e), all cards 22 that were selected in proper sequential order are identified. The game then proceeds to step (h) where a score or payoff is computed In step (h), a score (payoff if playing a wagering game) for the round of play is computed in accordance with a scoring rule. In a preferred embodiment, the scoring rule states that the player shall receive a score for one of the following using only cards 22 identified in step (g):

one pair jacks or better;

two pair;

three of a kind;

straight;

flush;

full house four of a kind;

straight flush;

royal flush;

sequence of three;

sequence of four; and, sequence of five.

In a preferred embodiment, the above scores are awarded only if the player placed a "odds" wager.

It can be appreciated that the scores differ for various hands. For example, a full house would be awarded a higher score (or payoff) than a pair of Kings. In a preferred scoring embodiment, the score (payoff) is a multiple of the player's wager. For example, a pair of Jacks, Queens, or Kings would pay two times the player's wager, or three of a kind would pay four times the player's wager, etc.

In another scoring embodiment, in step (h), the scoring rule states that if the selected cards form one of a straight, a flush, a straight flush, or a royal flush, and the first card selected in step (e) is the lowest ranking of said dealt cards, the player receives a score even if cards were not selected in the proper sequential order. For example, if the player selected AD, KD, QD, JD, and 10D, and the 10D was selected first and placed in the Low position, the player would receive a $1,000,000 payoff regardless of the order of the remaining cards. Again, in a preferred embodiment, this score is only awarded if the player placed an "odds" wager.

In another scoring embodiment, in step (h), the scoring rule states that if the selected cards form one of a straight, a flush, a full house, four of a kind, a straight flush, or a royal flush, the player receives a score (payoff) even if cards were not selected in proper sequential order. In a preferred embodiment, in order to receive this score, the player must have placed an "ante" wager.

In another scoring embodiment, in step (h), the scoring rule states that the player having the best poker hand wins the "ante" wager of the other players even if the cards were not selected in proper sequential order.

In another scoring embodiment, in step (h), if a player's cards form a royal flush, and if a 10 was the first card selected, the player receiving a payoff of one of (a) $1,000,000, (b) less than $1,000,000, or (c) more than $1,000,000. If this happens, every other player who placed an "ante" wager also receives a payoff.

In step (i), the round of play of card game 220 is ended.

EXAMPLES OF "MILLION $ STUD"

The following examples of rounds of play (hands) demonstrate the general principles of embodiment 20, and the specific principles of embodiment 220. The conditions for the examples are:

The deck consists of a standard deck of 52 playing cards to which one Joker has been added.

The ordering rule is equal or increasing value 2 through Ace. The Joker may be used as an Ace, or as a wild card in straights and flushes.

The dealing rule is initially dealing one card face up in the High position of a five card playing area.

The revealing rule is that the first dealt card is revealed to the player.

The selecting rule is that the player may select either the first dealt card, or a card from the top of the deck, and place the selected card in the playing area next to the last previously selected card. The first selected card is placed in the Low position.

The terminating rule is stop when five cards have been selected.

The scoring rule is to award a score (payoff) if the player has made an "odds" wager and achieves any of the following hands for all cards selected in sequence commencing with the first card selected:

one pair jacks or better;
two pair;
three of a kind;
straight;
flush;
full house;
four of a kind;
straight flush;
royal flush;
sequence of three;
sequence of four; and,
sequence of five.

The scoring rule further states that if the player has placed an "odds" wager, and the five dealt cards form a straight, flush, a straight flush, or a Royal Flush, a score (payoff) is awarded if the lowest ranking card was selected first, even if the other selections were not in proper sequential order.

The scoring rule further states that if the player has placed an "ante" wager and the dealt cards form one of a straight, a flush, a full house, four of a kind, a straight flush, or a royal flush, the player receives a score (payoff) even if cards were not selected in proper sequential order.

Note: The card in bold is the first dealt card. S=spades, H=hearts, D=diamonds, and C=clubs.

Round of Play #1 ("odds" wager and "ante" wager placed)
5C, 10D, 6H, KD, 6C
Result—both wagers lose Round of Play #2 ("odds" wager only placed)
3D, 8S, QD, 9C, 10D
Result—"odds" wager wins for three in sequence.

Round of Play #3 ("odds" wager only placed)
3H, 2H, JH, 10H, Joker
Result—cards form a flush, but not in proper sequence. No score for "odds" wager since lowest ranking card was not selected first. No score for out of sequence flush since no "ante" wager was placed.

Round of Play #4 ("odds" wager and "ante" wager placed)
2C, 3C, 6H, 5S, 4D
Result—cards form a straight, but not in proper sequence. Score for "odds" wager since the lowest ranking card was selected first. Score for "ante" wager for a straight even if out of sequence.

Round of Play #5 ("ante" wager only placed)
10S, QS, AS, JS, KS
Result—selected cards form an out of order straight flush with the lowest ranking card being selected first. Most unfortunately however, no score ($1,000,000) for "odds" wager since no "odds" wager was placed. Score for "ante" wager.

The preferred embodiments of the invention described herein are exemplary and numerous modifications, playing variations, and rearrangements can be readily envisioned to achieve an equivalent result, all of which are intended to be embraced within the scope of the appended claims.

We claim:

1. A method of playing an object selection game, comprising:

(a) starting a round of play;

(b) providing a set of objects, said set of objects containing a plurality of different individual objects, wherein each individual object has an order property in accordance with an ordering rule, said ordering rule defining a proper sequential order wherein said individual objects are ranked according to their said order properties;

(c) dealing a subset of said objects from said set of objects to a player in accordance with a dealing rule;

(d) revealing a portion of said subset of objects dealt in step (c) to the player in accordance with a revealing rule;

(e) the player selecting a previously unselected object from said subset of objects dealt in step (c) in accordance with a selecting rule;

(f) after each selection in step (e), using a terminating rule to test whether play shall stop, if "no" returning to step (e), if "yes" proceeding to step (g), wherein "yes" is true if either:

(1) the last two objects selected in step (e) are not in said proper sequential order in accordance with said ordering rule, or;

(2) all of said subset of objects dealt in step (c) have been selected;

(g) computing a score in accordance with a scoring rule; and (h) ending the round of play.

2. The method according to claim 1, further including:
said objects including a deck of playing cards.

3. The method according to claim 1, further including:
said order property of each said individual object capable of being hidden.

4. The method according to claim 3, further including:
said dealing rule stating that all of said subset of objects be dealt so that said order property is hidden.

5. The method according to claim 1, further including:
said dealing rule stating that from time to time after said subset of objects are dealt in step (c), additional objects may be dealt to the player.

6. The method according to claim 1, further including
before step (d), the player placing a wager.

7. The method according to claim 1, further including:
said revealing rule stating that either (1) zero, (2) one, or (3) more than one object of said subset of objects are revealed to the player.

8. The method according to claim 7, further including:
said revealing rule stating that said revealing occurs during said dealing of said subset of objects.

9. The method according to claim 7, further including:
said revealing rule stating that said revealing occurs after said dealing of said subset of objects.

10. The method according to claim 9, further including:
the player choosing said objects to be revealed.

11. The method according to claim 1, further including:
the player placing said selected objects in a playing area.

12. The method according to claim 11, further including:
the player placing a last said selected object adjacent to a next to last said selected object in said playing area.

13. The method according to claim 1, further including:
said ordering rule stating that said proper sequential order is one of:

increasing numerical value;
decreasing numerical value;
equal or increasing numerical value;
equal or decreasing numerical value;
alphabetical;
reverse alphabetical;

increasing card value ace through king;
decreasing card value king though ace;
equal or increasing card value ace through king;
equal or decreasing card value king through ace;
increasing card value two through ace;
decreasing card value ace though two;
equal or increasing card value two through ace; and,
equal or decreasing card value ace through two.

14. The method according to claim 1, further including:
said terminating rule stating:
a said selected object compared with more than one said previously selected object in accordance with said ordering rule.

15. The method according to claim 1, further including:
said scoring rule stating that the player shall receive a score according to how many said objects are selected in said proper sequential order prior to observing a "yes" in step (f).

16. The method according to claim 1, further including:
said scoring rule stating that the player shall receive a score if a certain combination of said objects is selected.

17. The method according to claim 1, further including:
said scoring rule stating that the player shall receive a score if a certain object is selected.

18. The method according to claim 1, further including:
a plurality of players participating in said object selection game.

19. A method of playing a card game, comprising:
(a) starting a round of play;
(b) providing a deck of playing cards, wherein each individual playing card has an order property in accordance with an ordering rule, said ordering rule defining a proper sequential order wherein said individual playing cards are ranked according to their said order properties;
(c) dealing a plurality of playing cards from said deck to a player in accordance with a dealing rule;
(d) revealing at least one of said cards dealt in step (c) to the player in accordance with a revealing rule;
(e) the player selecting any previously unselected card dealt in step (c), and placing said selected card in a playing area,
(f) after each selection, observing whether either (1) the last two cards selected in step (e) are not in said proper sequential order in accordance with said ordering rule, or (2) all of said subset of objects dealt in step (c) have been selected, if "no" returning to step (e), if "yes" proceeding to step (g);
(g) computing a score in accordance with said scoring rule; and
(h) ending the round of play.

20. The method according to claim 19, further including:
said deck of playing cards including a conventional deck of 52 cards.

21. The method according to claim 20 further including:
at least one of (1) multiple said decks of playing cards, (2) additional cards added to said deck of playing cards, (3) certain cards removed from said deck of playing cards, (4) one or more jokers which can be used as an ace, or as a wild card in straights and flushes, and (5) certain cards in said deck of playing cards being designated as wild.

22. The method according to claim 19, further including:
before step (d), the player placing a wager.

23. The method according to claim 19, further including:
in step (c), dealing either five, six, or seven cards to the player.

24. The method according to claim 19, further including:
said revealing rule stating that said revealing occurs during said dealing of said plurality of playing cards.

25. The method according to claim 19, further including:
said revealing rule stating that said revealing occur after said dealing of said plurality of playing cards.

26. The method according to claim 25, further including:
the player choosing said cards to be revealed.

27. The method according to claim 19, further including:
said ordering rule stating that said proper sequential order is one of:
increasing card value ace through king;
decreasing card value king though ace;
equal or increasing card value ace through king;
equal or decreasing card value king through ace;
increasing card value two through ace;
decreasing card value ace though two;
equal or increasing card value two through ace; and,
equal or decreasing card value ace through two.

28. The method according to claim 19, further including:
in step (g), said scoring rule stating that the player shall receive a score for one of the following prior to observing a "yes" in step (f):
one pair jacks or better;
two pair;
three of a kind;
straight;
flush;
full house
four of a kind;
straight flush; and,
royal flush.

29. The method according to claim 19, further including:
in step (g), exposing all said dealt cards; and,
if said dealt cards form one of a straight, a flush, a straight flush, or a royal flush, the player receiving a score even if said dealt cards were not selected in proper sequential order.

30. The method according to claim 19, further including:
in step (g), exposing all said dealt cards; and,
if said dealt cards form one of a straight, a flush, a straight flush, or a royal flush, and the first card selected in step (e) is the lowest ranking of said dealt cards, the player receiving a score even if said dealt cards were not selected in said proper sequential order.

31. The method according to claim 19, further including:
in step (g), exposing all said dealt cards; and,
if said dealt cards form one of a straight, a flush, a straight flush, or a royal flush, and the first and second cards selected in step (e) are in proper sequential order, the player receiving a score even if all said dealt cards were not selected in the proper sequential order.

32. The method according to claim 19, further including:
in step (g), exposing all said dealt cards; and,
if said dealt cards form one of a straight, a flush, a straight flush, or a royal flush, and the first, second, and third cards selected in step (e) are in proper sequential order, the player receiving a score even if all said dealt cards were not selected in the proper sequential order.

33. The method according to claim 19, further including:
in step (g), said scoring rule stating that the player shall receive a score for one of the following prior to observing a "yes" in step (f):

sequence of three;
sequence of four; and,
sequence of five.

34. The method according to claim 19, further including:

a plurality of players participating in said card game.

35. The method according to claim 19, further including:

said deck of playing cards including either (A) a conventional deck of 52 cards, or (B) a conventional deck of playing cards plus at least one of (1) multiple said decks of playing cards, (2) additional cards added to said deck of playing cards, (3) certain cards removed from said deck of playing cards, (4) one or more jokers which can be used as an ace, or as a wild card in straights and flushes, and (5) certain cards in said deck of playing cards being designated as wild;

before step (d), the player placing a wager;

in step (c), dealing either five cards or seven cards to the player;

said revealing rule stating that the player chooses one card to be revealed;

said ordering rule stating that said proper sequential order is either (1) equal or increasing card value ace through king, or (2) equal or increasing card value two through ace;

in step (g), said scoring rule stating that the player shall receive a score for one of the following prior to observing a "yes" in step (f):
one pair jacks or better;
two pair;
three of a kind;
straight;
flush;
full house
four of a kind;
straight flush;
royal flush;
sequence of three;
sequence of four; and
sequence of five;

in step (g), exposing all said dealt cards; and, if said dealt cards form one of a straight, a flush, a straight flush, or a royal flush, and the first card selected in step (e) is the lowest ranking of said dealt cards, the player receiving a score even if said dealt cards were not selected in the proper sequential order.

36. A method of playing a card game, comprising:

(a) starting a round of play;

(b) providing a deck of playing cards, wherein each individual playing card has an order property in accordance with an ordering rule, said ordering rule defining a proper sequential order wherein said individual playing cards are ranked according to their said order properties;

(c) dealing at least one said card from said deck to a player in accordance with a dealing rule;

(d) revealing at least one of said cards dealt in step (c) to the player in accordance with a revealing rule;

(e) the player selecting either (1) a card dealt in step (c) if not previously selected, or (2) a card from said deck of playing cards, and placing said selected card in a playing area;

(f) after each selection, observing whether a predetermined number of cards have been selected, if "no" returning to step (e), if "yes" proceeding to step (g);

(g) commencing with said first card selected in step (e), identifying all said cards that were selected in said proper sequential order;

(h) computing a score in accordance with said scoring rule; and (i) ending the round of play.

37. The method according to claim 36, further including:

said deck of playing cards including a conventional deck of 52 cards.

38. The method according to claim 37 further including:

at least one of (1) multiple said decks of playing cards, (2) additional cards added to said deck of playing cards, (3) certain cards removed from said deck of playing cards, (4) one or more jokers which can be used as an ace, or as a wild card in straights and flushes, and (5) certain cards in said deck of playing cards being designated as wild.

39. The method according to claim 36, further including:

before step (d), the player placing at least one wager.

40. The method according to claim 39, further including:

the player placing at least one of an "odds" wager and an "ante" wager.

41. The method according to claim 36, further including:

said dealing rule stating that at least one card is initially dealt to the player.

42. The method according to claim 36, further including:

said revealing rule stating that said at least one card dealt in step (c) is revealed to the player.

43. The method according to claim 36, further including:

in step (f), said predetermined number of cards being either five, six, or seven.

44. The method according to claim 36, further including:

said ordering rule stating that said proper sequential order is one of:
increasing card value ace through king;
decreasing card value king though ace;
equal or increasing card value ace through king;
equal or decreasing card value king through ace;
increasing card value two through ace;
decreasing card value ace though two;
equal or increasing card value two through ace; and,
equal or decreasing card value ace through two.

45. The method according to claim 36, further including:

in step (h), said scoring rule stating that if the player has placed an "odds" wager, the player shall receive a score for one of the following using only cards identified in step (g):
one pair jacks or better;
two pair;
three of a kind;
straight;
flush;
full house
four of a kind;
straight flush;
royal flush;
sequence of three;
sequence of four; and,
sequence of five.

46. The method according to claim 36, further including:

in step (h), said scoring rule stating that if said selected cards form one of a straight, a flush, a straight flush, or a royal flush, and the first card selected in step (e) is the lowest ranking of said selected cards, the player receiving a score even if said cards were not selected in said proper sequential order.

47. The method according to claim 36, further including:

in step (h), said scoring rule stating that the player shall receive a score for one of the following even if said cards were not selected in said proper sequential order:
straight;
flush;
full house;
four of a kind;
straight flush; and,
royal flush.

48. The method according to claim 36, further including:

a plurality of players participating in said card game.

49. The method according to claim 48, further including:

in step (h), the scoring rule stating that for all players placing "ante" wagers, the player having the best poker hand wins the "ante" wager of the other players, even if the player's cards were not selected in said proper sequential order.

50. The method according to claim 36, further including:

a dealer either (1) placing an "ante" wager, or (2) not placing an "ante" wager.

51. The method according to claim 36, further including:

in step (h), if a player's cards form a royal flush, and if a 10 was the first card selected, the player receiving a payoff of one of (a) $1,000,000, (b) less than $1,000,000, or (c) more than $1,000,000.

52. The method according to claim 36, further including:

said deck of playing cards including either (a) a conventional deck of 52 cards, or (b) a conventional deck of playing cards plus at least one of (1) multiple said decks of playing cards, (2) additional cards added to said deck of playing cards, (3) certain cards removed from said deck of playing cards, (4) one or more jokers which can be used as an ace, or as a wild card in straights and flushes, and (5) certain cards in said deck of playing cards being designated as wild;

before step (d), the player placing at least one wager;

said dealing rule stating that one card is initially dealt and revealed to the player;

in step (f), said predetermined number of cards being five;

said ordering rule stating that said proper sequential order is either (1) equal or increasing card value ace through king, or (2) equal or increasing card value two through ace;

in step (h), said scoring rule stating that if the player has placed an "odds" wager, the player shall receive a score for one of the following for all cards identified in step (g):
one pair jacks or better;
two pair;
three of a kind;
straight;
flush;
full house
four of a kind;
straight flush;
royal flush;
sequence of three;
sequence of four; and,
sequence of five;

in step (h), said scoring rule stating that if said selected cards form one of a straight, a flush, a straight flush, or a royal flush, and the first card selected in step (e) is the lowest ranking of said selected cards, the player receiving a score even if said cards were not selected in said proper sequential order; and, in step (h), said scoring rule stating that the player shall receive a score for one of the following even if said cards were not selected in said proper sequential order:
straight;
flush;
full house;
four of a kind;
straight flush; and,
royal flush.

* * * * *